US009999885B1

(12) United States Patent
Bhargava et al.

(10) Patent No.: US 9,999,885 B1
(45) Date of Patent: Jun. 19, 2018

(54) INTEGRATED FUNCTIONAL AND FLUIDIC CIRCUITS IN JOULE-THOMPSON MICROCOOLERS

(71) Applicant: LOCKHEED MARTIN CORPORATION, Bethesda, MD (US)

(72) Inventors: Krisna Bhargava, Santa Clara, CA (US); Mark Goodnough, Santa Ynez, CA (US); Elna Saito, Santa Barbara, CA (US); James Kreider, Goleta, CA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 159 days.

(21) Appl. No.: 14/291,746

(22) Filed: May 30, 2014

(51) Int. Cl.
*F25B 9/02* (2006.01)
*B01L 3/00* (2006.01)

(52) U.S. Cl.
CPC ..... *B01L 3/5027* (2013.01)

(58) Field of Classification Search
CPC ..... F25B 9/02; F25B 39/022; F25B 39/024; H01L 23/427; B81C 2201/0187; B01L 3/5027
See application file for complete search history.

(56) References Cited

U.S. PATENT DOCUMENTS 3,912,557 A 10/1975 Hochberg
4,386,505 A 6/1983 Little
4,392,362 A * 7/1983 Little ..... B21D 53/045 165/168
4,489,570 A 12/1984 Little
4,781,033 A 11/1988 Steyert et al.
(Continued)

FOREIGN PATENT DOCUMENTS

EP 0 337 802 10/1989
EP 0916890 5/1999
(Continued)

OTHER PUBLICATIONS

Baine et al., "Thermal vias for SOI Technology," Proc ICCCD International Conference on Communications, Computers and Devices, Kharagpur, India, 2000, p. 239-242.
(Continued)

*Primary Examiner* — Carlos A Rivera
(74) *Attorney, Agent, or Firm* — Terry M. Sanks, Esq.; Beusse Wolter Sanks & Maire, PLLC

(57) ABSTRACT

An apparatus includes a first substrate of a first material having a first bonding surface, and one or more fluidic channels open at a plane of the first bonding surface. The apparatus also includes a different second material disposed on the first substrate. The second material connects two different portions of the one or more fluidic channels. An outer surface of the second material is at the plane of the first bonding surface at positions between the two portions. The apparatus also includes a second substrate having a second bonding surface in contact with the first bonding surface, the second substrate configured to confine fluid flow within the one or more fluidic channels. In a Joule-Thompson cryocooler apparatus, the first material is a first thermally insulating material and the second material is a thermally conductive material and the second substrate is made of a second thermally insulating material.

20 Claims, 15 Drawing Sheets

(56) References Cited

U.S. PATENT DOCUMENTS

| | | | | |
|---|---|---|---|---|
| 4,785,879 | A | 11/1988 | Longsworth et al. | |
| 4,908,112 | A * | 3/1990 | Pace | B01L 3/502761 204/601 |
| 5,239,200 | A | 8/1993 | Messina et al. | |
| 5,249,425 | A | 10/1993 | Longsworth | |
| 5,382,797 | A | 1/1995 | Kunimoto et al. | |
| 5,611,214 | A | 3/1997 | Wegeng et al. | |
| 5,758,822 | A | 6/1998 | Yap | |
| 5,896,922 | A | 4/1999 | Chrysler et al. | |
| 5,920,133 | A | 7/1999 | Penswick et al. | |
| 5,974,808 | A | 11/1999 | Mangano et al. | |
| 6,041,821 | A | 3/2000 | Grossman | |
| 6,189,433 | B1 | 2/2001 | Harada | |
| 6,213,194 | B1 | 4/2001 | Chrysler et al. | |
| 6,463,744 | B1 | 10/2002 | Alexeev et al. | |
| 6,621,071 | B2 | 9/2003 | Sobel et al. | |
| 7,397,661 | B2 | 7/2008 | Campbell et al. | |
| 7,883,901 | B2 * | 2/2011 | Kitazawa | B01L 3/50273 422/402 |
| 8,141,556 | B2 | 3/2012 | Ruben | |
| 2003/0102435 | A1 | 6/2003 | Myers et al. | |
| 2005/0230085 | A1 | 10/2005 | Valenzuela | |
| 2005/0244660 | A1 * | 11/2005 | Yuasa | C09D 5/082 428/457 |
| 2006/0057407 | A1 * | 3/2006 | Sambasivan | C03C 17/22 428/472.3 |
| 2006/0103751 | A1 | 5/2006 | Lee | |
| 2006/0231237 | A1 * | 10/2006 | Dangelo | B82Y 10/00 165/104.28 |
| 2006/0277481 | A1 | 12/2006 | Forstall et al. | |
| 2007/0101297 | A1 | 5/2007 | Forstall et al. | |
| 2007/0118813 | A1 | 5/2007 | Forstall et al. | |
| 2007/0157220 | A1 | 7/2007 | Cordray et al. | |
| 2007/0209371 | A1 | 9/2007 | Sobel | |
| 2007/0245749 | A1 | 10/2007 | Atkins et al. | |
| 2008/0022310 | A1 | 1/2008 | Poling et al. | |
| 2009/0073066 | A1 | 3/2009 | Jordon et al. | |
| 2009/0126373 | A1 * | 5/2009 | Burg | A01N 1/02 62/51.1 |
| 2009/0193817 | A1 | 8/2009 | Germain et al. | |
| 2009/0258470 | A1 * | 10/2009 | Choi | C23C 16/308 438/386 |
| 2009/0272270 | A1 * | 11/2009 | McGill | B01J 20/205 96/101 |
| 2010/0262931 | A1 | 10/2010 | Woods et al. | |
| 2010/0283854 | A1 | 11/2010 | McKaughan et al. | |
| 2011/0010699 | A1 | 1/2011 | Cooper et al. | |
| 2011/0174467 | A1 | 7/2011 | Herbst | |
| 2012/0079838 | A1 | 4/2012 | Bin-Nun et al. | |
| 2012/0229959 | A1 * | 9/2012 | Holcomb | H05K 7/20372 361/676 |
| 2012/0309127 | A1 | 12/2012 | Farooq et al. | |
| 2013/0161705 | A1 * | 6/2013 | Disney | H01L 29/66446 257/263 |
| 2013/0180862 | A1 * | 7/2013 | Yoshida | C25B 1/003 205/340 |

FOREIGN PATENT DOCUMENTS

| | | |
|---|---|---|
| JP | 11-324914 | 11/1999 |
| JP | 4422977 | 3/2010 |
| KR | 10-1999-0057578 | 7/1999 |
| WO | 0001142 | 1/2000 |
| WO | 2009057950 | 5/2009 |
| WO | 2013016224 | 1/2013 |

OTHER PUBLICATIONS

Pope et al., "Development of a Two-Stage Alternate Joule-Thomson Cryo-Cooler for AAWS-M Risk Reduction," No. AMSMI-TR-RD-AS-91-22. Army Missile Command Redstone Arsenal AL Advanced Sensors Directorate, 1991, p. 1-22.

Little et al., "Microminiature refrigeration," AIP Conference Proceedings. vol. 985. No. 1. 2008.

Pradeep et al., "Analysis of Performance of Heat Exchangers used in Practical Micro Miniature refrigerators," Cryogenics 39.6 1999, p. 517-527.

Lerou et al., "All Micromachined Joule-Thomson Cold Stage," 2007 p. 437-441.

Little et al., "Development of a Low Cost, Cryogenic Refrigeration System for Cooling of Cryoelectronics," Advances in Cryogenic Engineering, Springer US, 1994, p. 1467-1474.

Chorowski et al., "Development and Testing of a Miniature Joule-Thomson Refrigerator with Sintered Powder Heat Exchanger," Advances in Cryogenic Engineering, Springer US, 1994, p. 1475-1481.

Lyon et al., "Linear Thermal Expansion Measurements on Silicon from 6 to 340 K," Journal of Applied Physics 48.3, 1977, p. 865-868.

McConnell et al., "Thermal Conductivity of Doped Polysilicon Layers," Microelectromechanical Systems, Journal of 10.3, 2001 p. 360-369.

Kumar et al, "Some Studies on Manufacturing and Assembly Aspects of Miniature J-T Coolers with Specific Regard to the Performance for Small Heat Loads," IJEST, Jan. 2011, pp. 660-664, vol. 3, No. 1, Metcalfe House Delhi, India.

Tzabar et al., "Development of a Miniature Fast Cool Down J-T Cryocooler," J-T and Sorption Cryocooler Developments, 2011, pp. 473-480, Int'l Cryocooler Conference, Inc., Boulder, CO.

Zhu et al, "A Planar Glass/SI Micromachining Process for the Heat Exchanger in a J-T Cryosurgical Probe," Dept. of Mech. Engineering, Feb. 2008, Madison, WI.

* cited by examiner 842
810

843
844
810

846
812

812

848
812

849
850
812

849
852
814

814

854
814

855
856
814

855
858
814

CHANNELS
802
COMPONENT
801
858
814

INTEGRATED FUNCTIONAL AND FLUIDIC CIRCUITS IN JOULE-THOMPSON MICROCOOLERS

BACKGROUND

As used here, a fluidic channel refers to a channel configured to carry a fluid in a substrate. Some devices require that fluidic channels be connected by a functional material different from a substrate material used to form the channels. For example, in some Joule-Thompson (JT) cryocoolers, in which a gas under pressures adiabatically expands through a nozzle into a low pressure chamber, the high pressure gas is thermally conditioned before entering the chamber by the temperature of the low pressure exhaust gases. A cryocooler implies a device designed to cool to very low temperatures, such as −150 degrees Celsius (° C.) or 130 Kelvin (K), and below. The thermal conditioning is accomplished, for example, through a thermally conductive material (as the functional material) different from the material serving as a substrate for channels, which is thermally insulating in order to support the adiabatic expansion.

When the fluidic channels are on the microscale (cross sectional dimensions from about 1 to about 1000 microns, 1 micron=$10^{-6}$ meters) or nanoscale (cross sectional dimensions from about 1 to about 1000 nanometers, nm, 1 nm=$10^{-9}$ meters) fabrication become challenging. In such cases, the functional material is often formed into a second layer, separate from a wafer serving as the substrate for the fluidic channels. A cover for the channels, with any reservoirs or access ports, is then formed in a third layer. The multilayer fabrication introduces complexity and expense in having three or more fabrication configurations and introduces challenges in alignment of the separately fabricated layers.

For example, some microscale JT cryocoolers have been fabricated using Micro-Electro-Mechanical Systems (MEMS) or Nano-Electro-Mechanical Systems (NEMS) micromachining, and semiconductor processing methods. These fabrication methods involve the use of three or more wafers as substrates to achieve the effective integration of fluidic circuits, and do not allow for the integration of thermally conductive material useful for such thermal conditioning as in a regenerative cooling design. The fabrication techniques involved (e.g., deep reactive ion etching, microparticle sand blasting, selective laser ablation) are highly complex, specialized, expensive, and often difficult to maintain in a manufacturing mode.

SUMMARY

Techniques are provided for manufactured devices using a repeatable, flexible, and economical fabrication process that enables industrial adoption for devices having fluidic channels at the microscale and nanoscale connected by a functional material separate from a substrate, such as for manufacture of devices comprising microfluidic JT cryocooler technologies (also called JT microcoolers herein). In some of these embodiments, the functional material is introduced for increased thermal conductivity. In other embodiments, the functional material is introduced for other functions, such as electrical conduction to reduce voltage buildup or to harvest current from a battery, or introduced for filtering to remove particles of a particular size or chemical composition from the fluid, or introduced to allow diffusion of one or more chemical constituents from high to low free energy in a fluidic circuit.

In a set of embodiments, an apparatus includes a first substrate of a first material having a first bonding surface along a plane, and one or more fluidic channels disposed in the first substrate and open at the plane of the first bonding surface and having at least two different portions. The apparatus also includes a different second material disposed on the first substrate. The second material connects the two different portions of the one or more fluidic channels; and, an outer surface of the second material is at the plane of the first bonding surface at positions between the two portions. The apparatus also includes a second substrate having a second bonding surface in contact with the first bonding surface. The second substrate is configured to confine fluid flow within the one or more fluidic channels.

In some embodiments, such as a Joule-Thompson cryocooler apparatus, the first material is a first thermally insulating material and the second material is a thermally conductive material and the second substrate is made of a second thermally insulating material. In some of these embodiments, the thermally conductive material is selected from a group comprising polysilicon and titanium/nickel alloy.

In some embodiments, the apparatus includes one or more fluidic channels disposed in the second substrate and open at a plane of the second bonding surface.

In some embodiments, the apparatus includes a layer of malleable sealing material disposed on at least one of the first substrate at the first bonding surface and the second substrate at the second bonding surface. In some of these embodiments, the sealing material has lower thermal conductivity than the thermally conductive material.

BRIEF DESCRIPTION OF THE DRAWINGS

A more particular description than the description briefly stated above is rendered by reference to specific embodiments thereof that are illustrated in the appended drawings. Understanding that these drawings depict only example embodiments and are not therefore to be considered to be limiting of its scope, various embodiments are described and explained with additional specificity and detail through the use of the accompanying drawings in which.

DETAILED DESCRIPTION

Figure 1A:
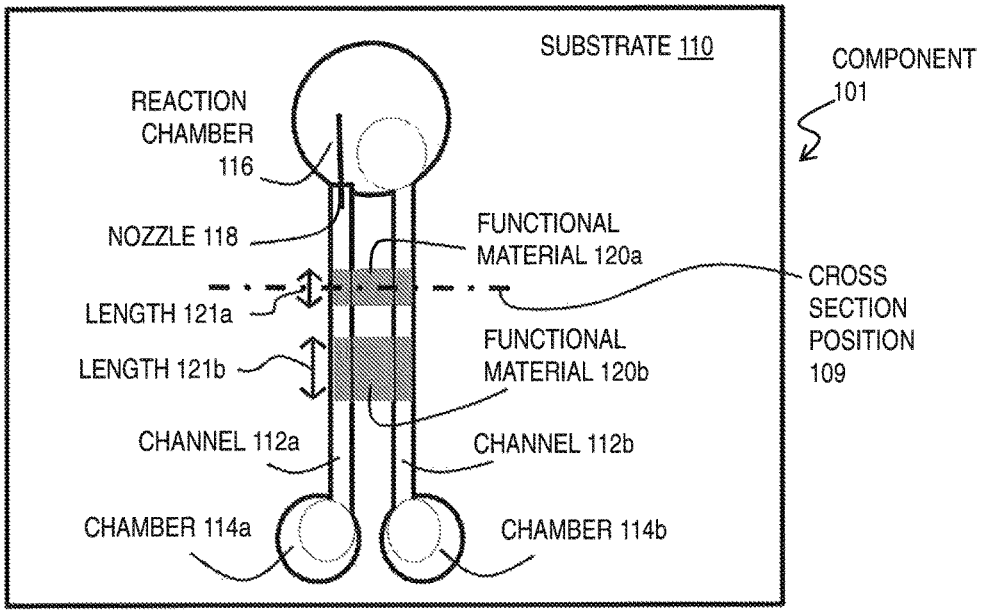
FIG. 1A is a block diagram that illustrates an example first component of a fluidic device, according to an embodiment.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Although some example embodiments are described below in the context of JT microcoolers, the methods of fabrication and resulting devices are not limited to such technology. In other embodiments, the methods and devices are utilized in other technologies that advantageously use functionalized fluidic devices, on the nanoscale or microscale or larger scales, such as batteries, environmental or medical testing equipment, chemical manufacture, chemical processing, water treatment, medical treatment, sensors, transducers, bioanalytical instruments, and any variety of fluid-handling systems.

FIG. 1A is a block diagram that illustrates an example first component 101 of a fluidic device, according to an embodiment. The first component 101 includes one or more fluidic channels, such as channels 112*a* and 112*b* (collectively referenced hereinafter as channels 112) formed in a substrate 110. In other embodiments, more or fewer channels are included, such as a single winding channel that folds back on itself to form a series of parallel channel portions. In the illustrated embodiment, the component 101 includes, in substrate 110, a reaction chamber 116 and one or more supply and exhaust chambers, such as chambers 114*a* and 114*b*, collectively referenced hereinafter as chambers 114. In other embodiments more or fewer or no chambers are included.

For example, in a JT microcooler, the channels 112 are microfluidic channels or nanofluidic channels or some combination. Non-ideal gas in the supply chamber 114 is under pressure and passes through nozzle 118 into the reaction chamber 116 at low pressure. In the reaction chamber 116, the non-ideal gas undergoes adiabatic (no exchange of heat) expansion, so the substrate 110 is advantageously made of a material that is thermally insulating. The low pressure gas (still a fluid) is the reaction product and is then used for cooling, e.g., for cooling of a contacting heat source built independent of the substrate. For example, some or all of the low temperature gas passes through an access port (depicted below with reference to FIG. 1B) in fluid communication with the reaction chamber and brought in contact with a heat exchanger to cool some object, such as an infrared detector. In some embodiments, some or all of the fluid from the reaction chamber, such as the product or a waste products or some combination, flows to an exhaust chamber, e.g., chamber 114*b*, for expulsion through another access port (e.g., depicted below with reference to FIG. 1B).

The component 101 also includes one or more functional materials deposited on the substrate in order to connect at least two portions of the channels 112. In the illustrated embodiment, functional material 120*a* is disposed on the substrate 110 to connect a portion of length 121*a* of channel 112*a* with a portion of channel 112*b*; and, functional material 120*b* is disposed on the substrate 110 to connect a different portion of length 121*b* of channel 112*a* with a different portion of channel 112*b*. In some embodiments, the functional materials 120*a*, 120*b* (collectively referenced hereinafter as functional material 120) and lengths 121*a*, 121*b* (collectively referenced hereinafter as length 121) are different. In some embodiments, the functional materials deposited in different parts of the substrate 110 of component 101 are the same and the lengths 121 are either also the same or are different. The type of functional material, the area of contact of the functional material with each portion of the channels 112 connected, and the length 121 and thickness of the material over the substrate barrier dividing the two portions are all selected to perform the desired function at a desired rate suitable for a given purpose, and can be determined by experiment or simulation. By depositing the functional material directly on the same substrate 110 that forms the channels, the component 101 obviates the need for an additional substrate used in previous approaches to provide the functional material, or its corresponding function. Later drawings depict example cross sections of component 101 or fabrication thereof at cross section position 109.

Figure 1B:
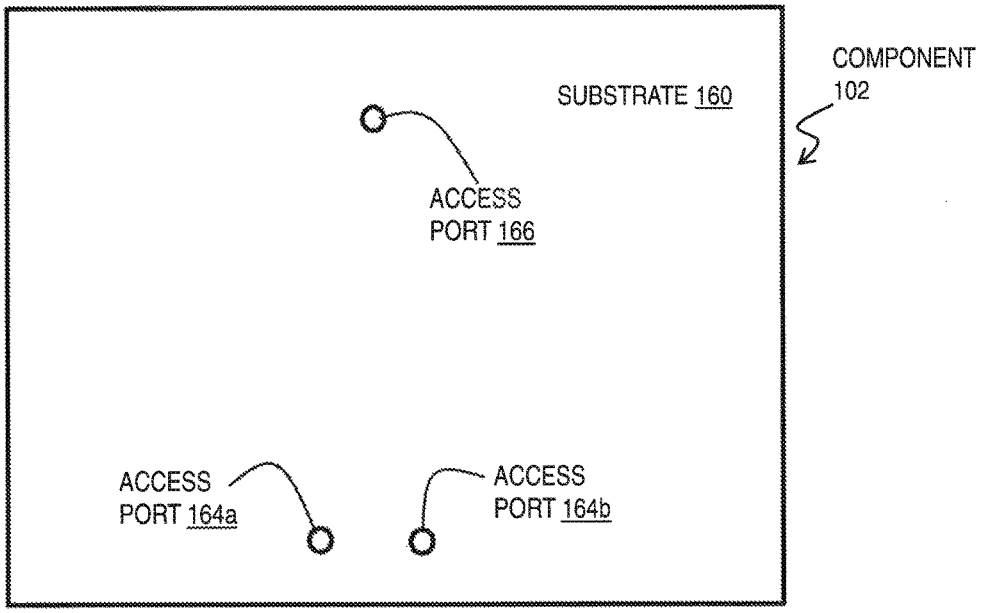
FIG. 1B is a block diagram that illustrates an example second component of a fluidic device, according to an embodiment.

By itself, component 101 has fluidic channels that are open to a surface of the substrate 110, and therefore not suitable for most purposes, including for gas fluids, or fluids that are advantageously shielded from an external environment. FIG. 1B is a block diagram that illustrates an example second component 102 of a fluidic device, according to an embodiment. The second component, also called a capping component, includes a second substrate 160 configured to be bonded to a bonding surface of the first substrate in order to enclose the one or more fluidic channels in the first substrate 110. Access ports for the channels in the first component 101 are advantageously formed in the substrate 160 of second component 102 to protect from the port formation process, such as drilling, any delicate features in the first component, such as, in some embodiments, microchannels or nanochannels or functional material connected thereto. In the illustrated embodiment, access ports 164*a*, 164*b* and 166 are configured to provide access to chambers 114*a*, 114*b* and 116, respectively. Any method may be used to form access ports.

Figure 1C:
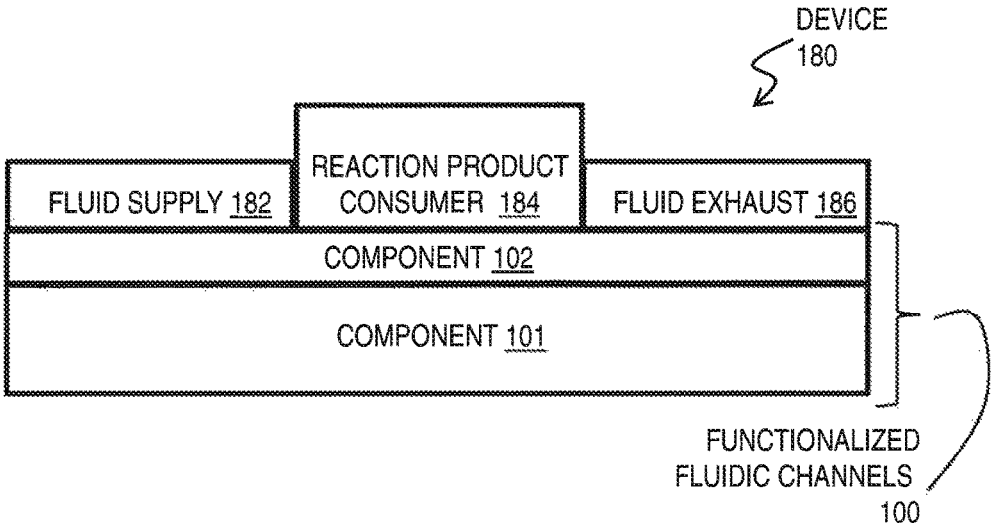
FIG. 1C is a block diagram that illustrates an example fluidic device, according to an embodiment.

FIG. 1C is a block diagram that illustrates an example fluidic device 180, according to an embodiment. FIG. 1C depicts, in elevation view, component 102 bonded to component 101 to enclose the fluidic channels in component 101 and thus confine fluid flow within the one or more fluidic channels. The combination of the two components 101 and 102 provides what is termed herein functionalized fluidic channels 100 also called functionalized fluid circuits.

The access ports in component 102 connect the fluidic channels in component 101 to one or more other components of the device. The other components include fluid supplies, such as fluid supply 182; one or more consumers of reaction product, such as reaction product consumer component 184; and zero or more fluid exhausts, including the ambient environment, such as fluid exhaust component 186. For example, in a JT microcooler, the fluid supply 182 is a gas mixture under pressure; consumer component is a cryostat 184, such as a metallic cold finger into which at least some of the cold expanded low-pressure as is routed, and fluid exhaust 186 is an opening to the environment or to a return line through a compressor.

Figure 1D:
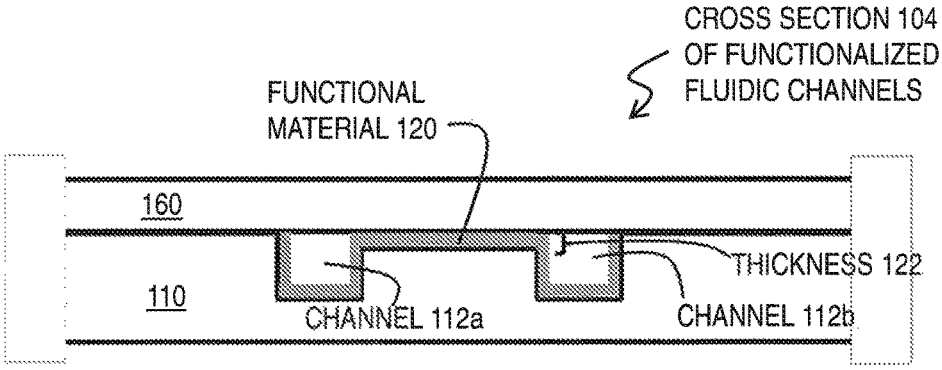
FIG. 1D is a block diagram that illustrates an example cross section through functionalized fluidic channels, according to an embodiment.

FIG. 1D is a block diagram that illustrates an example cross section 104 through functionalized fluidic channels, according to an embodiment. This cross section is positioned apart from any access ports, so that component 102 here comprises only capping substrate 160. This cross section is positioned where a functional material connects two portions of one or more channels, such as cross section position 109 where functional material 120*a* connects a portion of channel 112*a* to a portion of channel 112*b*. In the illustrated embodiment, the functional material 120 connects channel 112*a* to channel 112*b* at the chosen cross section in a layer of thickness 122. In the illustrated embodiment, the functional material also lines both side walls and the floor of the connected portions of the channels 112. However, in other embodiments, less than three walls are covered by the functional material. In some embodiments, the functional material only connects to one or both channels by the length 121 and thickness 122 of the functional material on the substrate barrier between the two channel portions.

A bonding surface of substrate 160 is configured to contact a bonding surface of substrate 110; and, thus the substrate 160 of capping component 102 is configured to close off the channels in substrate 110 of fluidic circuitry component 101. The thickness 122 of the functional material 120 between the channel portions advantageously matches the distance from the top of the substrate 110 between the connected channel portions and the bonding surface of substrate 160. Note that two substrates suffice to provide the functionalized fluidic channels, reducing the number of substrates that have to be processed during manufacture, compared to previous approaches using three or more substrates.

Figure 1E:
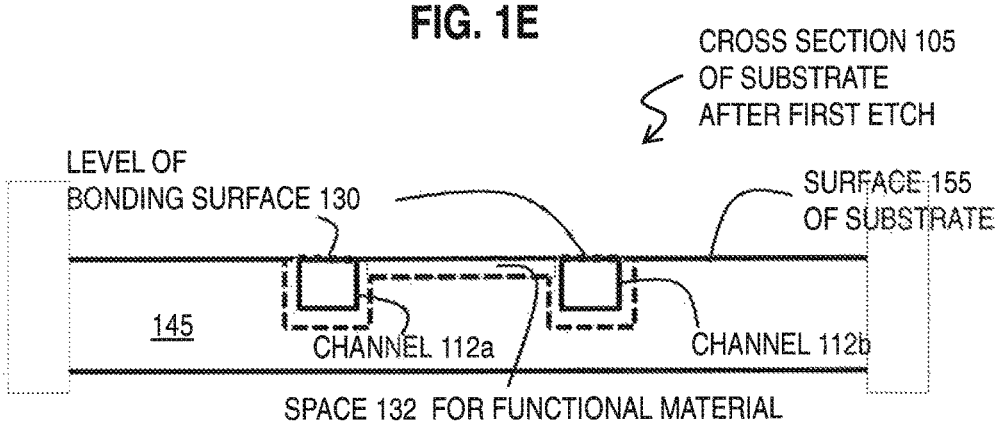
FIG. 1E is a block diagram that illustrates an example cross section through a first substrate after a first etch, according to an embodiment.

The next three drawings depict intermediate steps in the fabrication of the first component 101. FIG. 1E is a block diagram that illustrates an example cross section 105 through a first substrate after a first etch, according to an embodiment. The first etch acts on a wafer of a first material for the first substrate. Any suitable material may be used for the intended purpose. A glass or quartz wafer is used in many embodiments because glass and quartz forms fairly stiff wafers and is easily etched by many well-known integrated circuit and MEMS/NEMS techniques. Typically, both glass and quartz contain various oxides of Silicon, with the former arranged in an amorphous structure while the latter includes one or more crystals of one or more silicon oxides (silicon monoxide or silicon dioxide, or both). Two advantages of glass for JT microcoolers are that glass is thermally insulating for the adiabatic expansion and glass is transparent, which aids in properly aligning the second substrate and any access holes. Other materials used for the first substrate include any ceramics and plastics. For JT cooler applications, such materials with good thermal resistivity are advantageous.

The wafer is typically capable of holding many copies of the first component. The cross section 105 depicts two different portions of one or more channels in at least a part of one copy of the first component, such as the cross section 109 depicted in FIG. 1A. The surface of the wafer before etching defines a bonding surface. In FIG. 1E the wafer has been etched leaving a substrate 145 having a surface 155 that includes two channels, such as channel 112*a* and channel 112*b*. The level of the bonding surface 130 across the open channels 112 indicates where the second substrate 160 of the second component 102 will close off an open side of the channels 112 and confine fluid flow to stay within the channels 112. Also depicted in FIG. 1E is a space 132 to be occupied by the functional material 120. After the first etch, the space 132 is still filled with the first material of the first substrate.

Any method to selectively etch away the first material of the first substrate may be used. Examples includes, acid etching, plasma etching, deep reactive ion etching, microparticle sand blasting, selective laser ablation, gas etching, and arc discharge etching.

Figure 1F:
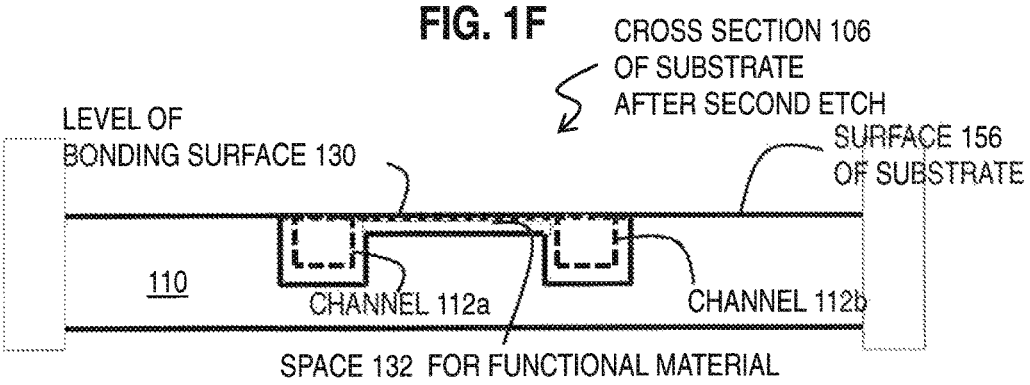
FIG. 1F is a block diagram that illustrates an example cross section through the first substrate after a second etch, according to an embodiment.

FIG. 1F is a block diagram that illustrates an example cross section 106 through the first substrate after a second etch, according to an embodiment. This etch has formed the final substrate 110 of the first material. The substrate 110 has a surface 156 that includes two deepened channels surrounding channel 112*a* and channel 112*b* and a reduced height substrate barrier between them. The difference between the surface 155 after the first etch and the surface 156 after the second etch is the space 132 to be occupied by the functional material 120. After the second etch, the space 132 is unfilled.

Figure 1G:
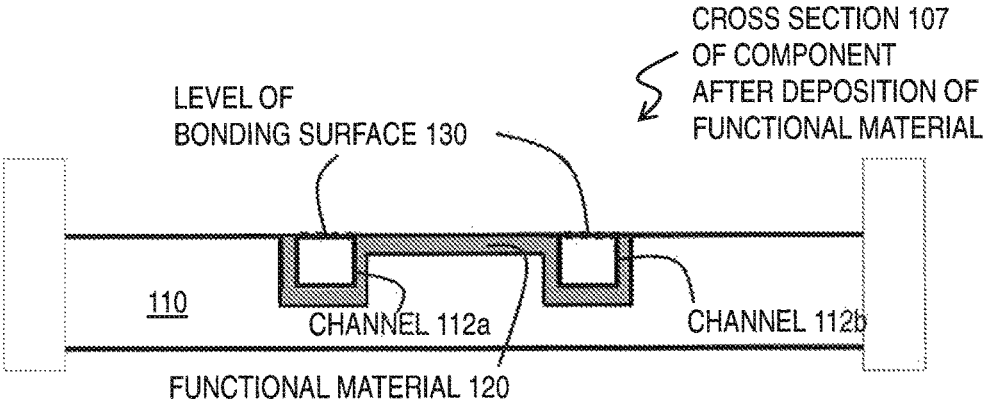
FIG. 1G is a block diagram that illustrates an example cross section through the first component, according to an embodiment.

FIG. 1G is a block diagram that illustrates an example cross section 107 through the first component, according to an embodiment. This cross section 107 is formed after the functional material 120 is deposited in the space 132 above substrate 110. The upper surface of the functional material forms the floor and side walls of the channels 112 and rises to the level 130 of the bonding surface above the barrier between the two channels. The functional material now connects the two portions of the channels 112. The first component 101 is now ready to be bonded to the capping component 102 to close off the channels and confine fluid flow to within the channels 112. The functional material is advantageously more solid than the fluids passing through the channel in order to confine the fluid to the channel; and, is typically a solid at operating temperatures Any suitable material different from the first material may be used as the functional material. Metals Ni, Cr, Ti, Au, Al, Ag, In, Sn, W, ITO, and others which can be deposited using thin film methods; and, serve as thermal and electrical conductors. Miscellaneous materials such as SiN, SiO, Si, Si(poly), Ge, Si(doped p or n) can serve as semiconductors and optical absorbers or emitters. Silicones, Epoxies, Hydrogels, Aerogels, Papers, Salt Bridges, Packed powders, impregnated ceramics, impregnated plastics can be used to impart filtering and permeability functionality or matrices for chemical reactions. Any method to deposit the functional material 120 in the space 132 may be used.

Figure 2:
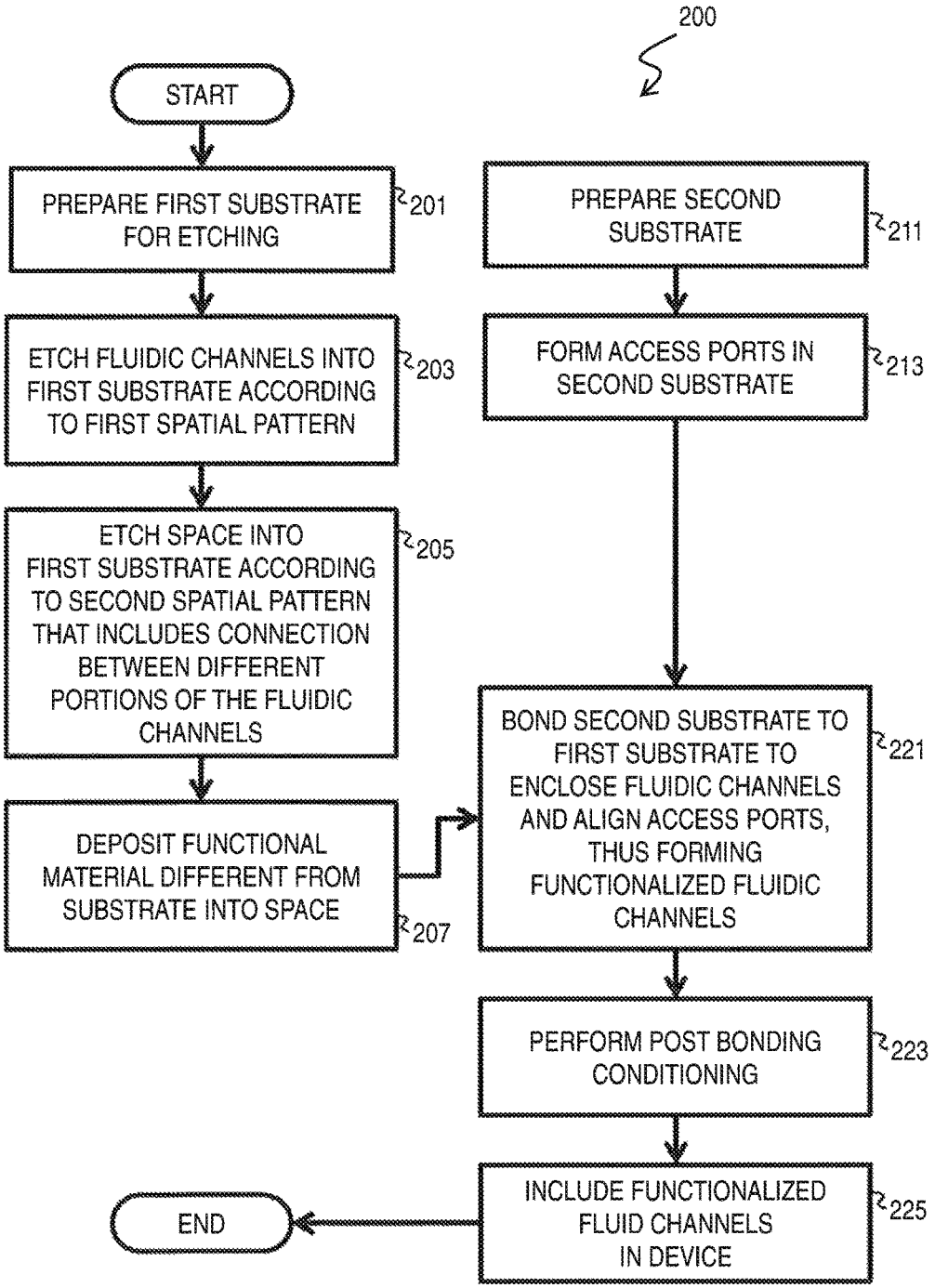
FIG. 2 is a flow chart that illustrates an example method for fabricating functionalized fluidic channels, according to an embodiment.

FIG. 2 is a flow chart that illustrates an example method 200 for fabricating functionalized fluidic channels, according to an embodiment. Although steps of method 200 (and in subsequent flow diagrams FIG. 3, FIG. 5, FIG. 6 and FIG. 7) are depicted as integral blocks in a particular order for purposes of illustration, in other embodiments, one or more steps, or portions thereof, may be performed in a different order or overlapping in time, in series or parallel, or are omitted, or additional steps are added, or the method is changed in some combination of ways.

In step 201, the first substrate is prepared for etching. For example, a wafer of the first material with a generally planar surface is cleaned to remove particulate matter on the surface of the substrate as well as any traces of organic, ionic, and metallic impurities.

In step 203, fluidic channels are etched into the first substrate according to a first spatial pattern. In some embodiments, the pattern is imposed using a computer controlled laser, sand jet or jet of liquid with abrasives. In some embodiments, the pattern is imposed using a lithographic mask, a removable layer of photosensitive material that resists etching (a photoresist), and an etching plasma or etching liquid, such as acid, as described in more detail in FIG. 3 for a particular embodiment of step 203. Such lithographic techniques as described in FIG. 3 offer the advantage of simultaneous fabrication of multiple copies on a single wafer compared to laser or abrasive jets.

In step 205, space for the functional material is etched into the first substrate according to a second spatial pattern. In some embodiments, the pattern is imposed using a computer controlled laser, sand jet or jet of liquid with abrasives. In some embodiments, the pattern is imposed using lithographic techniques, as described below with reference to FIG. 3. In some embodiments, spaces for several different functional materials are etched simultaneously during step 205, for example by etching constant depths but to different lengths or including different numbers of walls of the channels or some combination. In other embodiments, step 205, or steps 205 and 207, described next, are repeated for each different functional material included.

In step 207 one or more different functional materials are deposited into the spaces etched into the first substrate during step 205. In some embodiments, the material is imposed using a computer controlled jet or 3D printer. In some embodiments, the material is deposited using a lithographic mask, a removable layer of photosensitive material that promotes removal (a photoresist), and a blanket depositing process, such as sputtering, as described in more detail in FIG. 5 for a particular embodiment of step 207. Such lithographic techniques as described in FIG. 5 offer the advantage of simultaneous fabrication of multiple copies on a single wafer compared to computer controlled jets or printing. The functional material is deposited to a thickness such that when the first substrate is bonded to a second substrate, as described below, the second material deposited between the channels prevents noticeable fluid transfer between the channels in any gap between the second material and the level of the bonding surface 130. A gap that is small enough to cause a Reynolds number usually less than 1, but sometimes as high as 100 is dominated by viscous forces that prevent significant fluid movement. In some embodiments, the second material is deposited to a thickness that extends beyond the level of the bonding surface 130 and is ground away in a subsequent step before bonding, e.g., in a chemical-mechanical polishing step.

In step 211 a second substrate of the same or different material from the first substrate material is prepared as a capping component. For example, a wafer of a second material with a generally planar surface is cleaned to remove particulate matter on the surface of the substrate as well as any traces of organic, ionic, and metallic impurities. In various example embodiments, the substrate is fabricated from a glass or silicon type material, or from Pyrex glass. In some embodiments, step 211 includes forming channels or functional material or both on the second substrate as well, as described above for the first substrate, and illustrated in more detail below with reference to FIG. 9. In some embodiments, step 211 includes depositing a sealing material on the second substrate to ensure proper fluid flow isolation between channels connected by the functional material, as also depicted in FIG. 9, described below. The sealing material provides a different function than the functional material, and is soft enough to conform to irregularities in the bonding surface and close any fluid path between channels connected by the functional material.

In step 213 one or more access sports are formed in the second substrate. For example, through the use of photolithographic techniques, a mask is laid upon the substrate and a pattern defining port regions are exposed thereon whereby a selected portion of the layer is subsequently exposed to an etchant and washed away. In some embodiments, after the formation of an $O_2$ or $SiO_2$ layer, photoresist is applied to the surface of the second substrate. In example embodiments, a pattern of port regions on the substrate are photo-lithographically defined; and, the substrate is etched in an acid. Thereafter, in some embodiments, measurements are performed via profilometry. As used herein, profilometry refers to the use of a technique for the measurement of the surface shape of an object, such as laser scanning, scanning electron microscopy, interferometer, pin-drop and Atomic Force Microscopy. Once the desired profile is etched, a high speed drilling process is performed to create input and output ports. Final measurements are taken and the capping, second component is cleaned and processed through a dehydration baking step.

In step 221, the capping component comprising the second substrate with any access ports is bonded to the bonding surface of the first component comprising the first substrate with any functionalized fluidic circuitry. During bonding, access ports are aligned with the channels and any chambers in the first component. Thus, during step 221 functionalized fluidic channels are formed. A particular bonding process, used in some embodiments, is described in more detail below with reference to FIG. 6.

In step 223, post-bonding conditioning is performed, such as further cleaning and testing for desired performance. A particular post-bonding conditioning process, used in some embodiments, is described in more detail below with reference to FIG. 7.

In step 225, the functionalized fluidic channels are incorporated into a device, such as device 180, like a JT cryocooler for an infrared detector.

Figure 3:
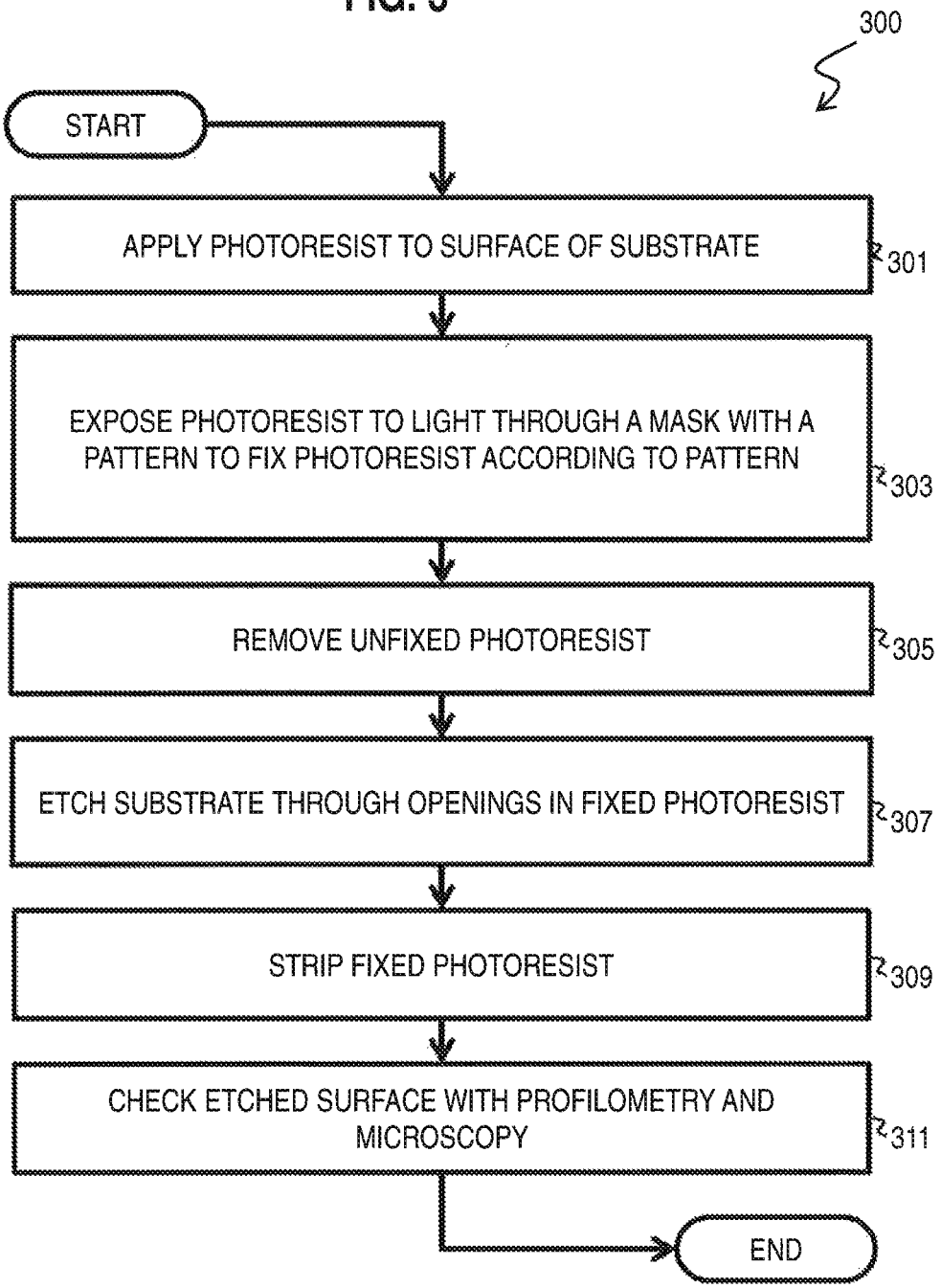
FIG. 3 is a flow chart that illustrates an example method for performing an etching step of the method of FIG. 2, according to an embodiment.

FIG. 3 is a flow chart that illustrates an example method 300 for performing an etching step of the method of FIG. 2, according to an embodiment. Thus method 300 is one embodiment for performing the steps 203 or 205 or both of the method 200 depicted in FIG. 2. The method 300 uses photolithographic techniques that provide advantages of scale compared to point etching, drilling or cutting techniques. A first pattern of channels along the substrate is photo-lithographically defined. In step 301, a photoresist material is deposited on the surface of the wafer for the first substrate. In step 303, the photoresist is exposed to light through a mask with a pattern to fix portions of the photoresist according to the pattern. In step 305, the photoresist that has not been fixed is removed by an appropriate developer to leave openings (windows) that reveal the substrate.

In step 307, the substrate is etched, e.g., using an acid solution, through the openings (windows) in the fixed substrate. For example, in various embodiments, the acid is hydrofluoric acid or phosphoric acid. In step 309, the fixed photoresist patterned by the photolithography is stripped away using a different solution or grinding process. Thereafter, the resulting surface is checked, optionally, in step 311, e.g., using profilometry.

As will be appreciated by those skilled in the art, there are two types of photoresists: positive and negative, either or both of which may be used in various embodiments. For positive resists, the resist is exposed with light (such as ultraviolet, UV, light) wherever the underlying resist is to be removed. In these resists, exposure to the light changes the chemical structure of the resist so that it becomes more soluble in the developer. The exposed resist is then washed away by a developer solution, leaving windows to the bare substrate material. The unexposed resist remains on the substrate. The mask, therefore, contains an exact copy of the pattern of resist which is to remain on the wafer. Negative resists behave in an opposite manner from positive resists. Exposure to light, such as UV light, causes the negative resist to become polymerized, and more difficult to dissolve. Therefore, the negative resist remains on the surface wherever it is exposed, and the developer solution removes only the unexposed portions. Masks used for negative photoresists, therefore, contain the inverse (or photographic "negative") of the pattern of resist to be transferred to the substrate. Negative resist is more resistant to acids for etching. Because negative resists typically harden by covalent bonding (polymeric crosslinking), negative resists form an almost reactively inert layer. Typically negative resists are epoxies, which gives them good mechanical durability and stable properties over extended times.

Figure 4A:
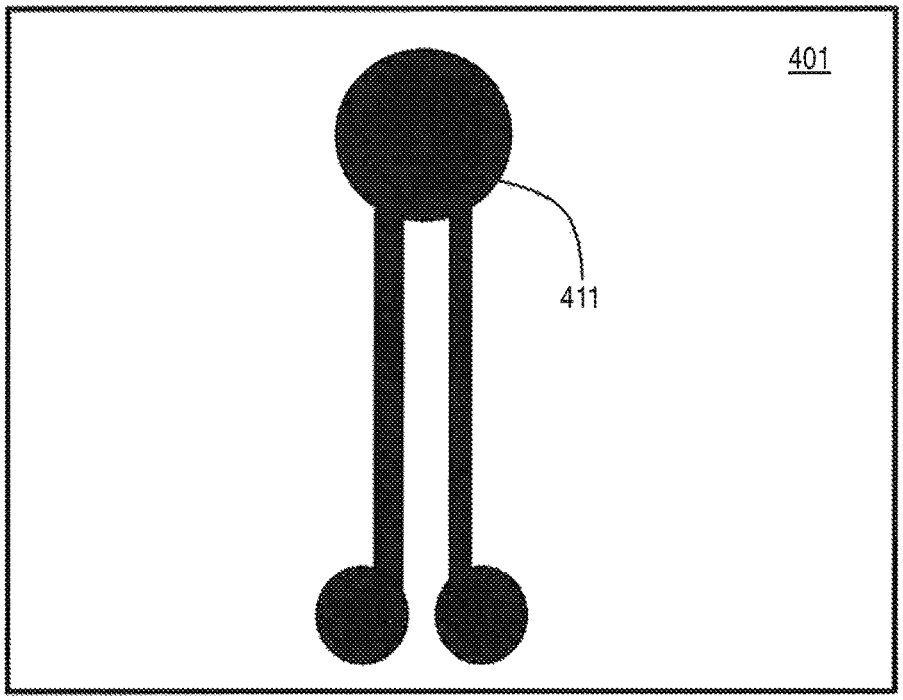
FIG. 4A and FIG. 4B are block diagrams that illustrate example masks for a photolithographic step for etching the fluidic channels of FIG. 1A, according to various embodiments.
Figure 4B:
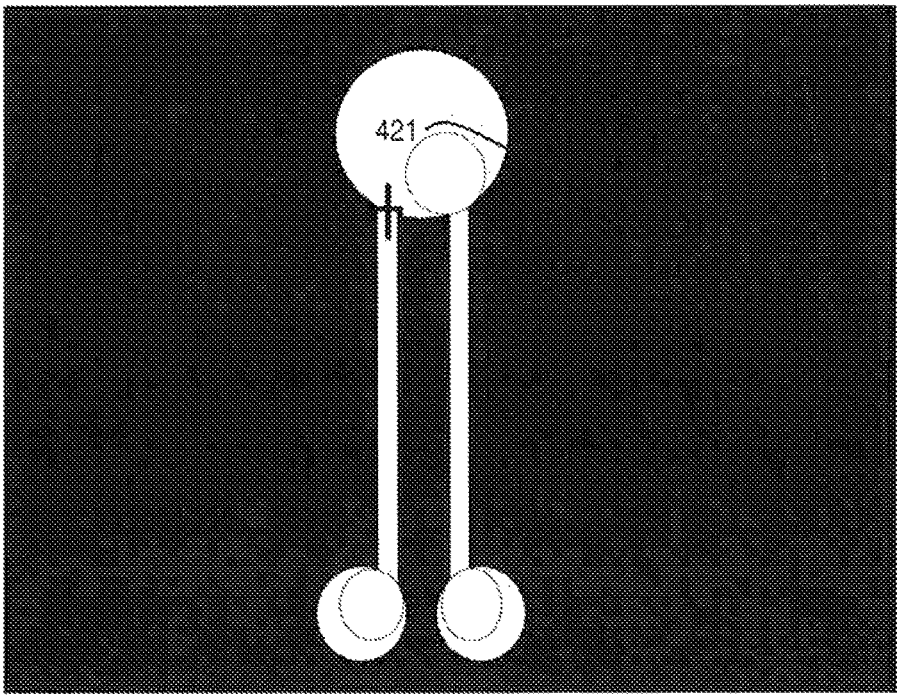

FIG. 4A and FIG. 4B are block diagrams that illustrate example masks for a photolithographic step for etching the fluidic channels of FIG. 1A, according to various embodiments. For example, a mask 401 for a negative resist for the channels and chambers of FIG. 1 is depicted in FIG. 4A. In FIG. 4A, the dark areas 411 indicate where light is blocked and the resist is not polymerized but will wash away in the developer. These areas become windows to the substrate and allow an etching solution to remove the substrate. Thus the channels and chambers of FIG. 1 are formed in the substrate. Correspondingly, a mask 402 for a positive resist for the channels and chambers of FIG. 1 is depicted in FIG. 4B. In FIG. 4B, the dark areas 421 indicate where light is blocked and the resist will not wash away in the developer. The complementary white areas indicate where the light passes through to the resist and render it soluble in the developer. These white areas become windows to the substrate and allow an etching solution to remove the substrate. Thus, in some embodiments, the channels and chambers of FIG. 1 are formed in the substrate using one of the masks 401 or 402 in method 300 to perform step 203.

Figure 4C:
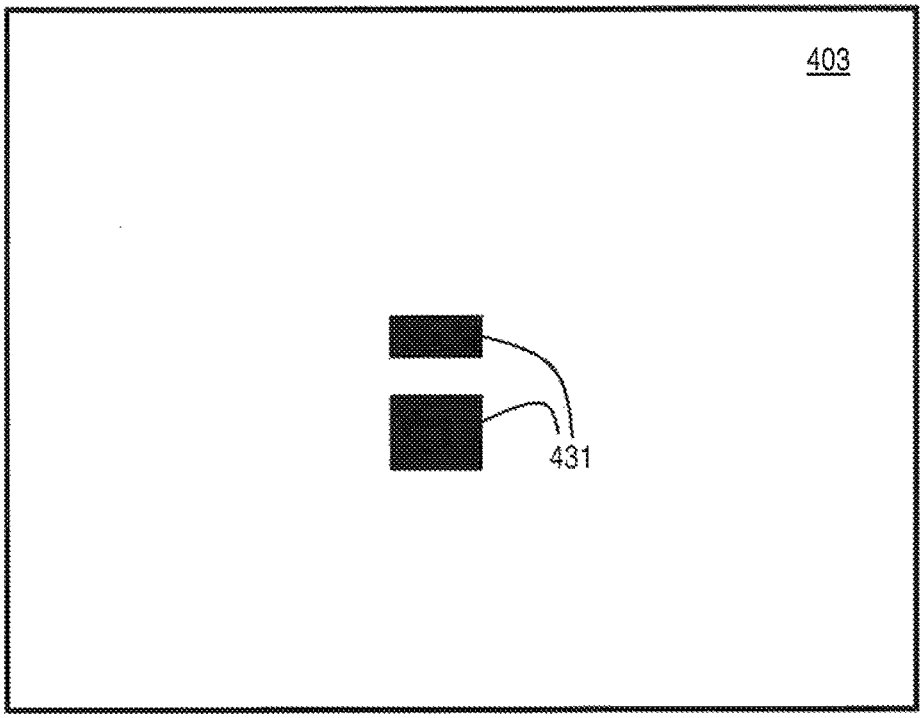
FIG. 4C and FIG. 4D are block diagrams that illustrate example masks for a photolithographic step for etching space for the functional material of FIG. 1A, according to various embodiments.
Figure 4D:
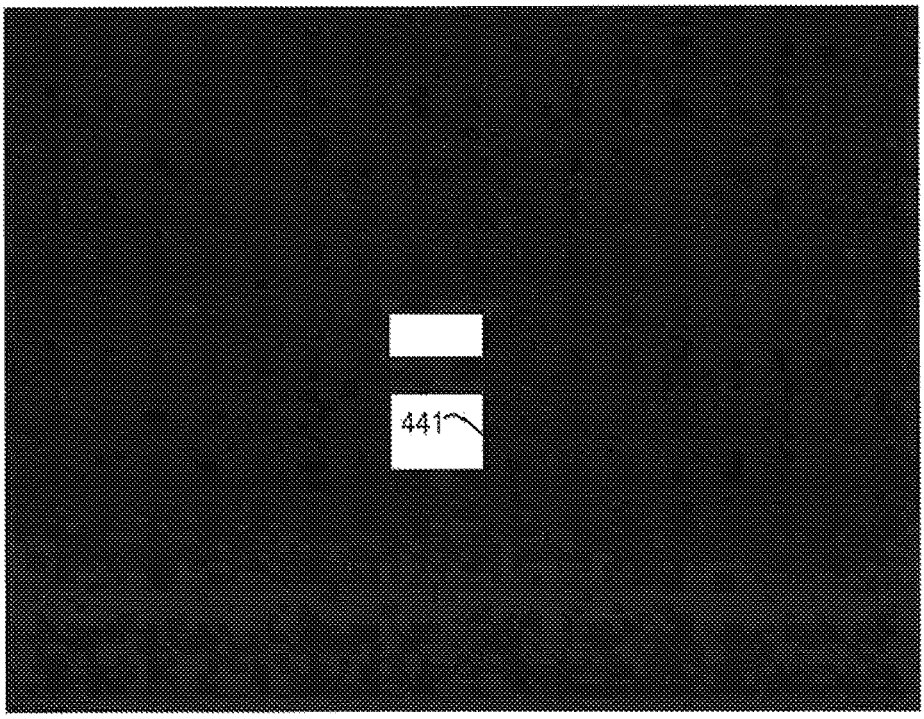

FIG. 4C and FIG. 4D are block diagrams that illustrate example masks for a photolithographic step for etching space for the functional material of FIG. 1A, according to various embodiments. For example, a mask 403 for a negative resist for the functional material of FIG. 1 is depicted in FIG. 4C. In FIG. 4C, the dark areas 431 indicate where light is blocked and the resist is not polymerized but will wash away in the developer. These areas become windows to the substrate and allow an etching solution to remove the substrate material. Thus the spaces for the functional material of FIG. 1 are formed in the substrate. Correspondingly, a mask 404 for a positive resist for the functional material of FIG. 1 is depicted in FIG. 4D. In FIG. 4D, the dark areas 441 indicate where light is blocked and the resist will not wash away in the developer. The complementary white areas indicate where the light passes through to the resist and render it soluble in the developer. These white areas become windows to the substrate and allow an etching solution to remove the substrate. Thus, in some embodiments, the spaces for the functional material of FIG. 1 are formed in the substrate using one of the masks 403 or 404 in method 300 to perform the second etching in step 205 of method 200 in FIG. 2.

Figure 5:
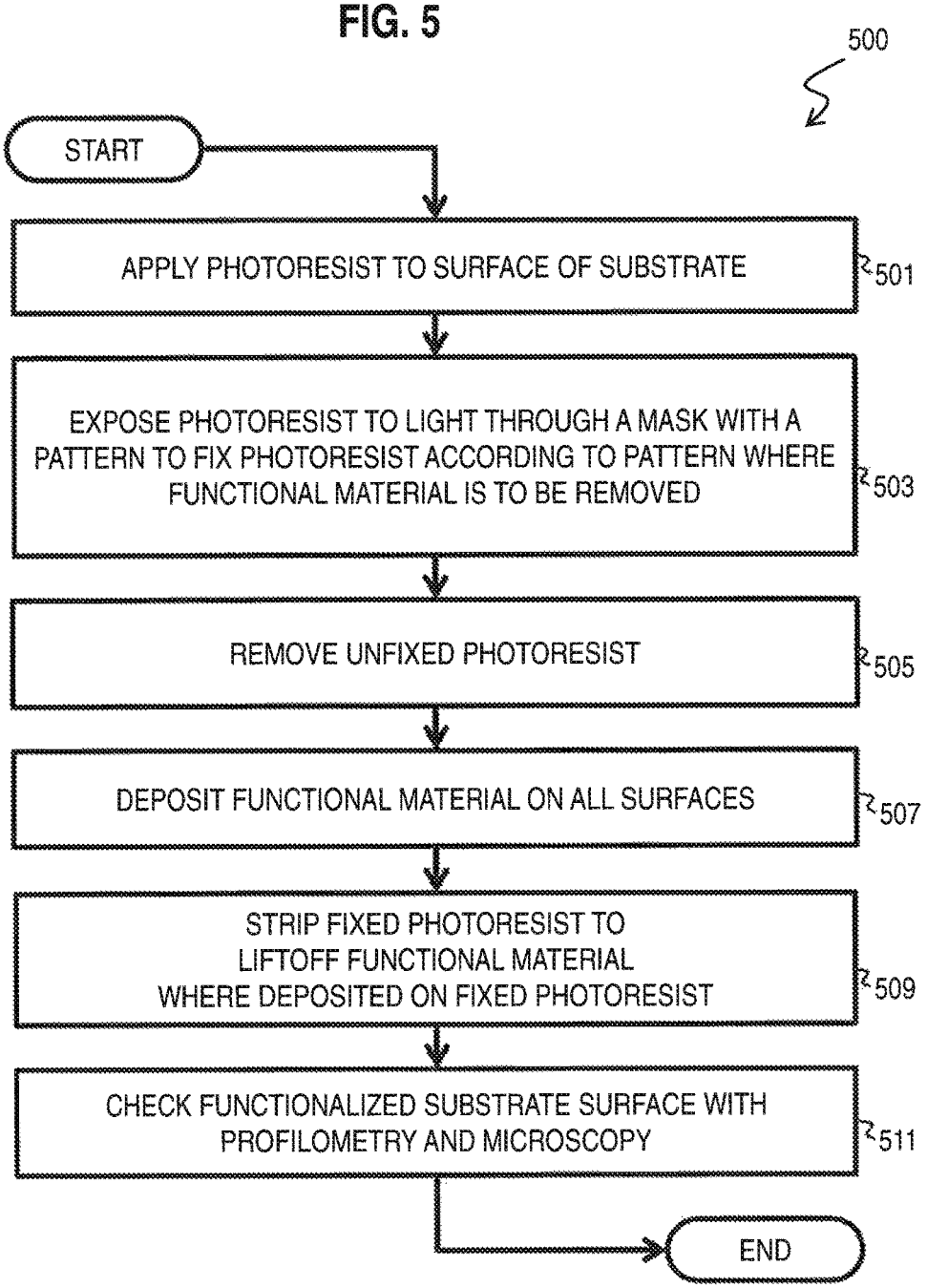
FIG. 5 is a flow chart that illustrates an example method for performing a deposition step of the method of FIG. 2, according to an embodiment.

FIG. 5 is a flow chart that illustrates an example method for performing a deposition step of the method of FIG. 2, according to an embodiment. Thus method 500 is one embodiment for performing step 207 of the method 200 depicted in FIG. 2. The method 500 uses photolithographic techniques that provide advantages of scale compared to point deposition and printing head embodiments.

Once the desired space is etched and measured, a liftoff pattern is photo-lithographically defined upon the substrate, similar to the pattern that etched space for the functional material. In step 501 the photoresist that will define the lift off pattern is applied to the substrate. In step 503 the photoresist is exposed to light through a mask with a pattern to fix the photoresist according to the pattern where the functional material is to be lifted off. In various embodiments, the liftoff pattern is similar to the pattern that formed the space, as depicted in FIG. 4C for negative resist or 4D for positive resist, but can be somewhat different if the etching proceeds under the original mask, and the final deposit area is somewhat larger than the window used to etch the space, as shown below with reference to FIG. 8. In some embodiments, a different functional material is to be deposited in different spaces (e.g., functional material 120*a* is different from functional material 120*b*), and the liftoff pattern has a window corresponding to only one of those two spaces etched. In step 505 the unfixed photoresist is removed to leave windows where the functional material is to remain deposited on the substrate.

In step 507 a functional material, such as a thermally conductive counter-flow heat exchanger (CFHX) material or film, is deposited. Example CFHX materials, e.g., for JT microcooler applications made with SiO substrates, include polysilicon or titanium/nickel. The functional material contacts the substrate only in the windows of the pattern; and, lies above the photoresist everywhere else. In step 509, the fixed photoresist is stripped off, thus lifting off the functional material where it was deposited on the fixed photoresist, and leaving the functional material only in the windows of the pattern. Optional, additional profilometry measurements are taken in step 511.

Figure 6:
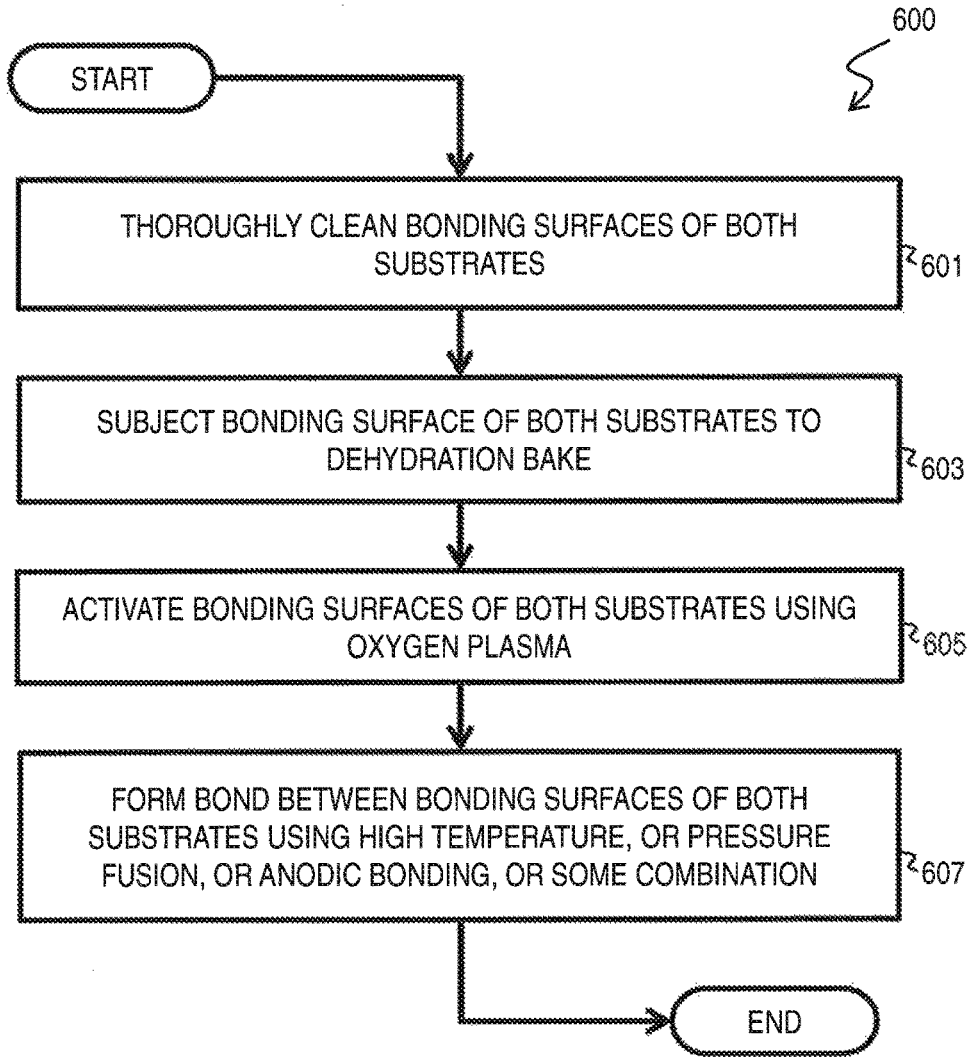
FIG. 6 is a flow chart that illustrates an example method for performing a bonding step of the method of FIG. 2, according to an embodiment.

FIG. 6 is a flow chart that illustrates an example method 600 for performing a bonding step of the method of FIG. 2, according to an embodiment. Thus method 600 is one embodiment for performing step 221 of the method 200 depicted in FIG. 2. In step 601 the wafers for one or both substrates are cleaned and generally prepared for bonding to each other. For example, in some embodiments, any second material that extends beyond the level of the bonding surface 130 of the first substrate is ground away. Optionally, in step 603, the bonding surfaces, at least, of one or both wafers are subjected to a dehydration bake to remove excess liquids from any of the previous processes. Optionally, in step 605, a final oxygen plasma surface activation is performed. One skilled in the art will appreciate that the phrase oxygen plasma surface activation generally means a method of functionalizing the surface of the substrate by means of plasma processing. It is done with the intent to alter or improve adhesion properties of surface prior to coating or bonding. In some embodiments, weakly ionized low energy oxygen plasma is used to functionalize surfaces which may not have immediately desirable surface chemistry for bonding, such as in the elevated regions of the CFHX material areas.

In step 607, the bonding surfaces of both substrates are bonded using any appropriate techniques, alone or in some combination. For example, wafers are bonded together using high temperature pressure fusion, high-voltage anodic bonding, controlled adhesives and glass flit (though the latter is not recommended for focal plane array optical detectors), moderate or high-temperature fusion techniques, and further reinforced under the influence of a high-strength electric field, depending on the material of the substrate or functional material.

Figure 7:
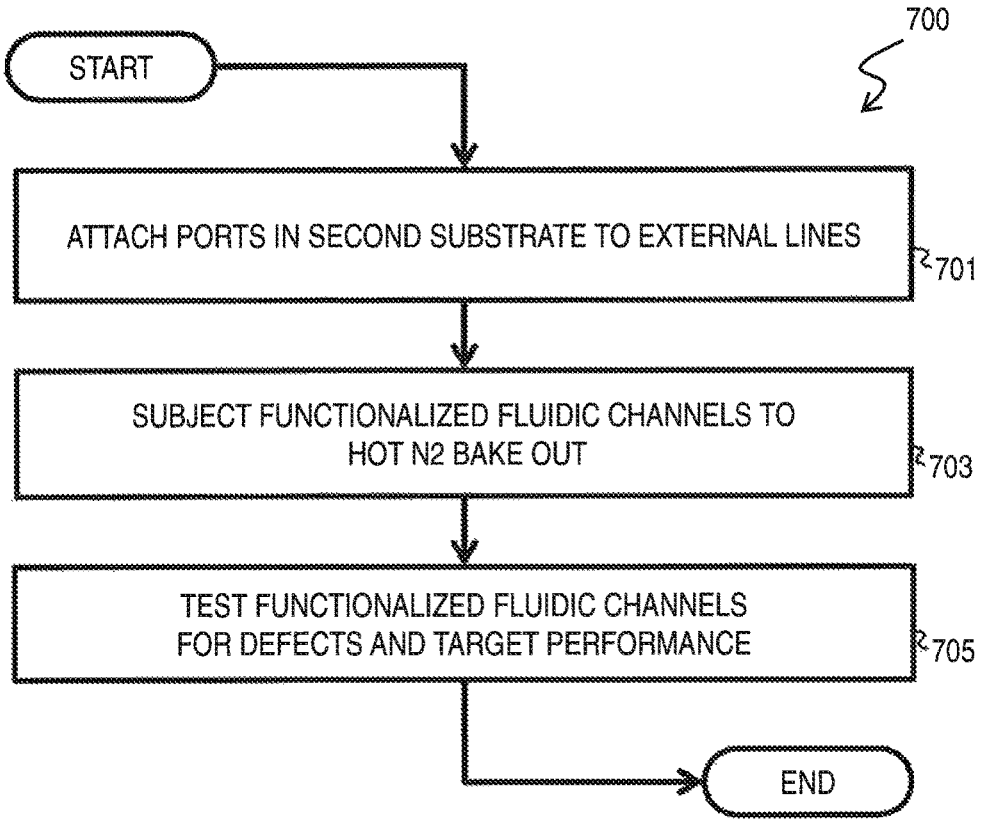
FIG. 7 is a flow chart that illustrates an example method for performing a post-bonding step of the method of FIG. 2, according to an embodiment.

FIG. 7 is a flow chart that illustrates an example method for performing a post-bonding step of the method of FIG. 2, according to an embodiment. Thus method 700 is one embodiment for performing step 223 of the method 200 depicted in FIG. 2. In step 701, access ports in the second, capping substrate (e.g., substrate 160) are attached to external components. For example, input and output ports are attached to a JT heat exchanger or cryostat. A hot nitrogen bake is then performed in step 703 to eliminate potential contaminants trapped in the functionalized fluidic channels and bond line. In step 705, the functionalized fluidic channels are then inspected for correct bonding and tested for the particular use.

FIG. 8A through FIG. 8L are block diagrams that illustrate an example series of results on a first substrate of the method of FIG. 2, FIG. 3 and FIG. 5, according to an embodiment. For purposes of illustration, the embodiment is assumed to be formation of a JT cryocooler. By fabricating a JT cryocooler using the above described method, in a particular embodiment, only two wafers are required. Further, a simple, repeatable, and scalable process is provided which allows precision in manufacture of JT cryocoolers.

Figures 8A, 8B, 8C, 8D, 8E, 8F, 8G, 8H, 8I, 8J, 8K, 8L:
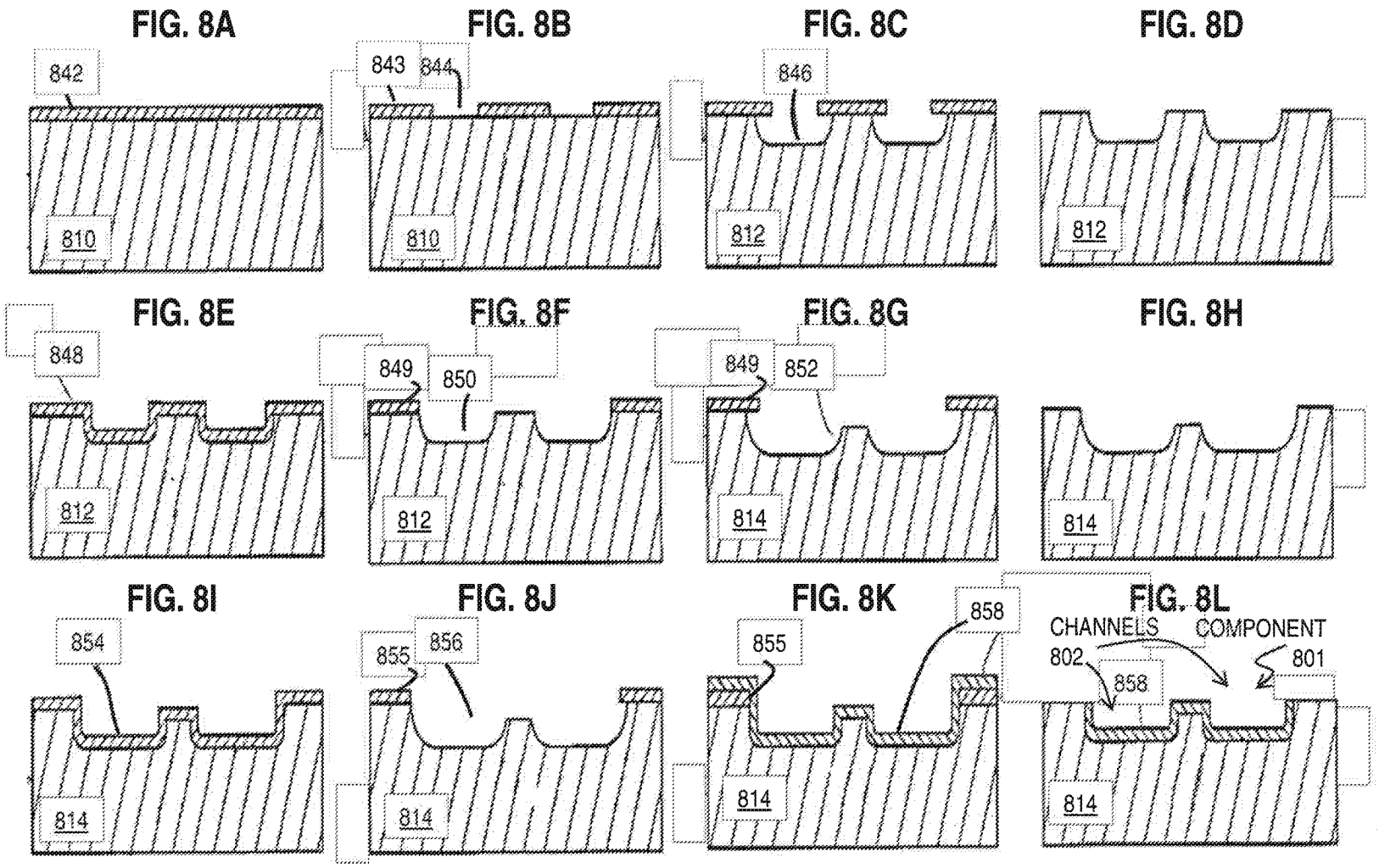
FIG. 8A through FIG. 8L are block diagrams that illustrate an example series of results on a first substrate of the method of FIG. 2, FIG. 3 and FIG. 5, according to an embodiment.

As shown in FIG. 8A, a substrate wafer 810 is provided and, after cleaning, a photoresist 542 is deposited thereon. In FIG. 8B, a first pattern with windows 844 defining a plurality of channels constituting the fluidic circuit is formed in the fixed photoresist 843 by photolithographic exposure to UV light and rinsing with a developer. Thereafter, as shown in FIG. 8C, portions of the substrate material are selectively etched away by exposure to an acid, to which the photoresist is resistant, leaving a newly shaped etched substrate 812. Note that substrate material under the edges of the fixed photoresist 843 has also been etched away, increasing the width of the channels 846 compared to the photoresist pattern based on the mask. As shown in FIG. 8D, the substrate 812 with channels 848 is cleaned of extraneous etch mask photoresist material 843.

As shown in FIG. 8E, a second photoresist material 518 is deposited on the substrate 812 to photolithographically define a plurality of CFHX regions constituting the thermal circuit or thermal function. As shown in FIG. 8F, a second pattern with window 850 defining a space for deposition of the functional material is formed in the fixed photoresist 849 by photolithographic exposure to UV light and rinsing with a developer. As shown in FIG. 8G, the substrate material is further etched by exposure to acid, in order to expand the space 852 for the functional CFHX material, leaving a twice etched substrate 814. The fixed photoresist is resistant to the acid used. Again note that substrate material under the edges of the fixed photoresist 849 has also been etched away, increasing the width of the space 852 compared to the photoresist pattern based on the mask. As shown in FIG. 8H, the substrate 814 is cleared of extraneous fixed photoresist material 849.

As shown in FIG. 8I, a third photoresist 854 is applied to the substrate 814 for lithographically defining a lift off area after a functional material has been deposited. As shown in FIG. 8J, a third pattern with window 856 defining a space for permanent deposition of the functional material is formed in fixed photoresist 855 by photolithographic exposure to UV light and rinsing with a developer. As shown in FIG. 8K, a CFHX material film 858 is deposited upon the substrate 814 and fixed photoresist 855 using any know deposition techniques, such as evaporative deposition, Physical vapor deposition, chemical vapor deposition, additive methods such as 3d printing and selective deposition, screen printing, lithographic methods. As shown in FIG. 8L, the CFHX film 528 overlying the fixed photoresist 855 has been lifted off by a solution that removes the fixed photoresist 855, to form a first component 801 with CFHX material 858 lining and connecting portions of channels 802.

In example embodiments, a manufacturing process template is provided which reduces the design of a planar, JT cryocoolers to only two wafers. In general, both wafers are advantageously made of thermally insulating material. One of the two wafers contains integrated thermal material and fluidic circuits coplanar to one another and with respect to the substrate plane. The other wafer is optically transparent and serves as an access substrate, or "capping wafer", which closes fluidic channels defined on the circuit wafer and bears holes for inlets/outlets. Any node in the thermal connections or fluidic circuits can be accessed by tapping the capping wafer, allowing connection with input/output lines for characterization probes. In example embodiments, the wafer of the first substrate is typically fabricated from a glass, quartz, or other silicon-based materials, but other materials may be used as long as they are thermally insulating. If the wafer for the first substrate is selected to be transparent like its capping wafer counterpart, the JT cryostat will have the advantage of being completely optically transparent. In still other example embodiments, the substrate is composed of Pyrex glass. Significant production advantages are provided by a fabrication process wherein a thermally functionalized fluidic circuit wafer is manufactured in two stages of wet chemical etching, thin film deposition, and photolithographic liftoff processing. Subsequent to the manufacture of each wafer, the two wafers are bonded using thermal fusion or anodic techniques depending on the material selection of the substrates and thermal material.

In example embodiments, a fabrication process is provided for rapid prototyping of a device built with ion-bearing glass substrates. The fabrication process includes the steps of fabricating a thermofluidic circuit wafer, then the steps of fabricating a capping wafer, and then bonding the thermofluidic circuit wafer and the capping wafer to one another. More specifically, in example embodiments, the thermofluidic circuit wafer is fabricated by a two stage wet chemical etch process followed by an evaporative deposition step and related low-resolution photolithographic liftoff processing. The process begins with the provision of a generally planar, thermally insulating glass substrate that is cleaned to remove particulate matter or traces of organic, ionic, and metallic impurities on the working surface. After cleaning, an "etch-mask" layer such as negative photoresist is fabricated on the surface of the wafer substrate. Through the use of photolithographic techniques, a pattern which defines where fluidic channels are to be fabricated in the underlying glass substrate is defined on the etch-mask layer, which exposes the substrate in those regions. The substrate is selectively etched in an acid (e.g. concentrated hydrofluoric acid) to form the fluidic circuit channels. Thereafter, measurements are performed by profilometry to verify desired geometry; and, the remainder of the hard-mask is selectively etched away. Fluidic channels with depths and widths each in a range from about 100 nm to about 1 millimeter (mm, 1 mm=$10^{-3}$ meters), spaces 20 nm or more apart, are readily formed for a large number of copies.

A second etch mask is fabricated photo-lithographically corresponding to counter-flow heat exchanger (CFHX) regions constituting the thermal functionalization in the same manner as for the fluidic circuit. The substrate is again etched in an acid, measurements are performed a second time by profilometry, and the etch mask is stripped from the substrate leaving the CFHX regions at an elevation slightly lower than that of the substrate plane. Once the desired profile is achieved, a CFHX liftoff pattern is photo-lithographically defined directly upon the substrate and thermally-conductive CFHX material is deposited and lifted off regions where it is not desired. Final measurements are taken to ensure that the relative elevation of all surfaces destined for bonding are nearly in plane with one another. CFHX films of thickness 50 microns and separations of 10 microns are readily deposited in desired patterns. For metal functional materials, even thinner layers of 5 to 10 micron thickness and 1 micron separation are readily deposited in a desired pattern. Optionally, a final oxygen plasma surface activation is performed to ease future bonding processes.

In example embodiments, the capping wafer is provided for bonding to the thermofluidic circuit wafer. A thermally insulating, optically transparent wafer such as glass is provided. The wafer is cleaned and holes are drilled where access to thermally functionalized fluidic circuitry is desired. The wafer can also be oxygen plasma surface activated to ease future bonding processes. Advantageously, this fabrication process allows for the potential production of optically transparent, JT microcoolers, enabling a variety of system configurations for devices used to cool focal plane arrays (FPA) and other photo-sensitive sensors or detectors.

In some embodiments, channels or functional material or both are disposed on the second substrate as well, before bonding, as described in more detail below for embodiments of a Joule-Thompson cryocooler with reference to FIG. 9.

Figure 9A:
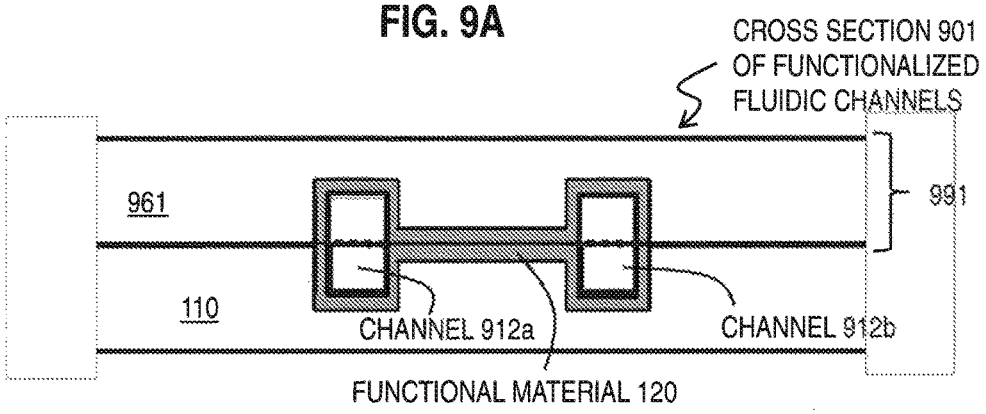
FIG. 9A through FIG. 9D are a block diagrams that illustrate example cross sections of functionalized fluidic channels, according to other embodiments.

FIG. 9A through FIG. 9D are a block diagrams that illustrate example cross sections of functionalized fluidic channels, according to other embodiments. FIG. 9A is a block diagram that illustrates an example cross section 901 of functionalized fluidic channels according to one embodiment. FIG. 9A shows that a substrate 961 of a capping wafer component 991 has been etched with channels that align with the channels in the substrate 110 to form heightened channels 912*a* and 912*b*. The capping wafer component 992 has also had functional material 120 deposited thereon to coat the portions of channels 912*a* and 912*b* on all sides. The bonding level shown by dashed lines passes through the heightened channels 912*a* and 912*b*. In many embodiments, the pattern, such as a lithographic mask, for the channels in the capping wafer substrate 961 is the mirror image of the pattern for the channels in the substrate 110, both for the channels and for the space where functional material 120 is to be deposited. Thus, before bonding the capping wafer, one or more fluidic channels are etched into the capping substrate (e.g., substrate 961) according to a complementary spatial pattern that causes the one or more fluidic channels in the capping substrate (e.g., substrate 961) to align with the one or more fluidic channels in the first substrate to form heightened channels (e.g., 912*a* and 912*b*). In other embodiments, only some of the channels are etched into the capping substrate so only some of the channels are heightened channels.

Figure 9B:
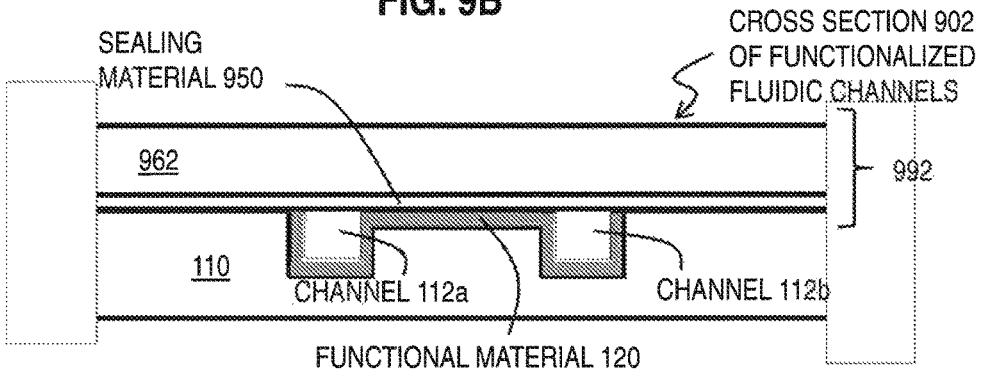

FIG. 9B is a block diagram that illustrates an example cross section 902 of functionalized fluidic channels according to another embodiment. FIG. 9B shows that a substrate 962 of a capping wafer component 992 has a layer of sealing material 950 on the bonding surface. In some embodiments, the sealing material 950 is applied to the substrate 110 in addition to or instead of applying the sealing material 950 to the capping substrate 962. Thus, before bonding the capping substrate, a sealing material 961 is deposited on one or both of the first substrate 110 and capping substrate 961. As stated above, the sealing material provides a different function than the functional material, and is soft enough to conform to irregularities in the bonding surface and close any fluid path between channels connected by the functional material.

Figure 9C:
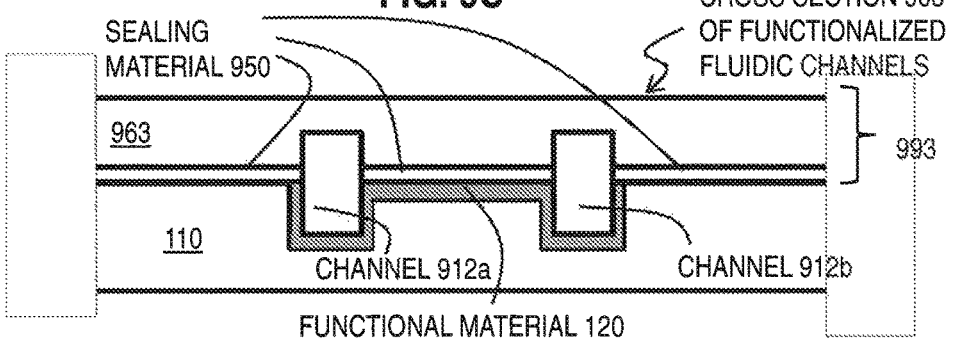

FIG. 9C is a block diagram that illustrates an example cross section 903 of functionalized fluidic channels according to yet another embodiment. FIG. 9C shows that a substrate 963 of a capping wafer component 993 has been etched with channels that align with the channels in the substrate 110 to form heightened channels 912*a* and 912*b*. The bonding level passes through the heightened channels 912*a* and 912*b*. In many embodiments, the pattern, such as a lithographic mask, for the channels in the capping wafer substrate 963 is the mirror image of the pattern for the channels in the substrate 110. Thus, before bonding the capping wafer, one or more fluidic channels are etched into the capping substrate (e.g., substrate 963) according to a complementary spatial pattern that causes the one or more fluidic channels in the capping substrate (e.g., substrate 963) to align with the one or more fluidic channels in the first substrate (e.g., substrate 110) to form heightened channels (e.g., 912*a* and 912*b*). In other embodiments, only some of the channels are etched into the capping substrate so only some of the channels are heightened channels. Substrate 963 of the capping wafer component 993 also has a layer of sealing material 950 on the bonding surface. In some embodiments, the sealing material 950 is applied to the substrate 110 in addition to or instead of applying the sealing material 950 to the capping substrate 963.

Figure 9D:
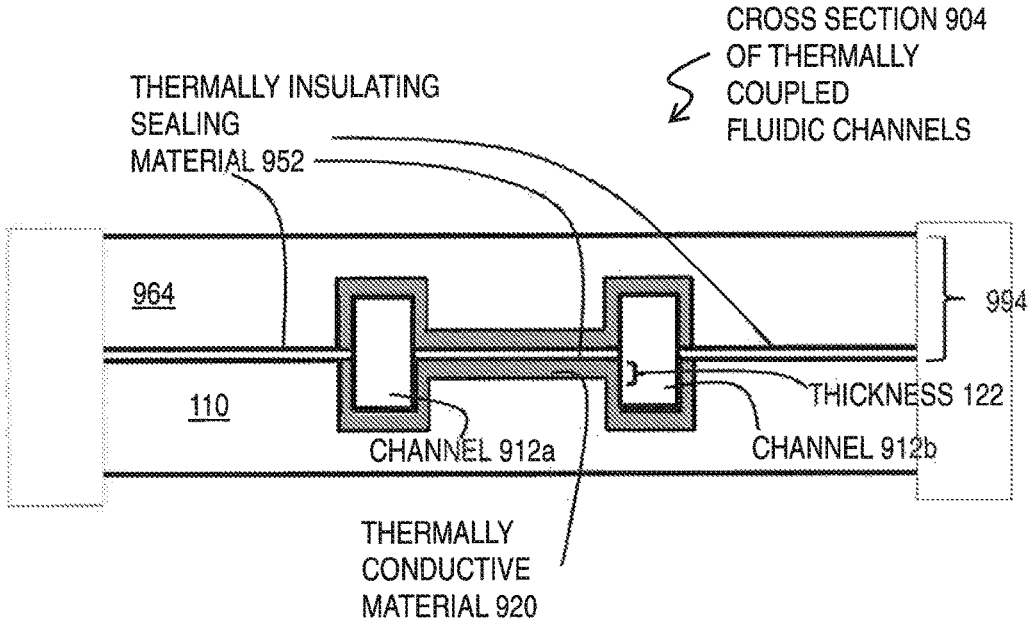

FIG. 9D is a block diagram that illustrates an example cross section 904 of functionalized fluidic channels according to another embodiment. FIG. 9D shows that a substrate 964 of a capping wafer component 994 has been etched with channels that align with the channels in the substrate 110 to form heightened channels 912*a* and 912*b*. For purposes of illustration it is assumed that the functional material is thermally conductive material 920 compared to the material of substrates 110 and 964, as is useful in Joule-Thompson cryocooler embodiments described in more detail below. The capping wafer component 994 has also had thermally conductive material 920 deposited thereon to coat the portions of channels 912*a* and 912*b* on all sides. The bonding level passes through the heightened channels 912*a* and 912*b*. In many embodiments, the pattern, such as a lithographic mask, for the channels in the capping wafer substrate 961 is the mirror image of the pattern for the channels in the substrate 110, both for the channels and for the space where thermally conductive material 920 is to be deposited. In other embodiments, only some of the channels are etched into the capping substrate so only some of the channels are heightened channels. Substrate 964 of the capping wafer component 994 also has a layer of sealing material, such as thermally insulating sealing material 952 compared to the thermal conductivity of material 920, on the bonding surface. In some embodiments, the sealing material 952 is applied to the substrate 110 in addition to or instead of applying the sealing material 952 to the capping substrate 964. In either case, a layer of sealing material 952 less conductive than the material 920 divides the thermally conductive material 920. This sealing material ensures that fluid does not flow through any gap along the bonding surface between connected channels 912*a* and 912*b*. For example, in some Joule-Thompson cryocoolers, the thermally conductive material 920 is a polysilicon or a titanium/nickel alloy, while the thermally insulating sealing material 952 is gold, a malleable metal suitable for closing gaps. While gold has good thermal conduction for many applications, the thermal conductivity of gold is much lower than the thermal conductivity of polysilicon or of titanium/nickel alloys.

Figure 10:
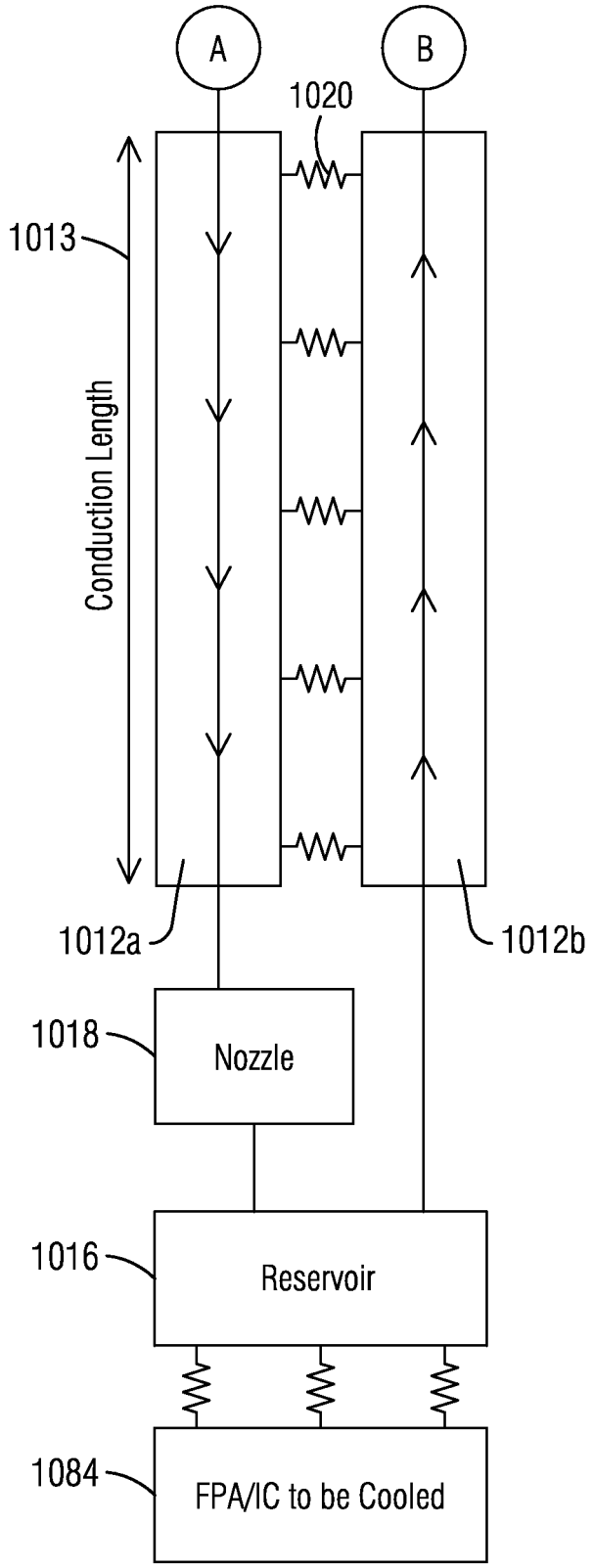
FIG. 10 is a block diagram that illustrates example fluidic and thermal circuits that introduce a region of counter-flow heat exchange (CFHX) in a Joule-Thompson cryocooler, according to an embodiment.

FIG. 10 is a block diagram that illustrates example fluidic and thermal circuits that introduce a region of counter-flow heat exchange (CFHX) in a Joule-Thompson cryocooler, according to an embodiment. The non-ideal gas under pressure flows from a source A through a channel 1012*a* to a nozzle 1018 into an expansion chamber called reservoir 1016. The exhaust low pressure gas flows through channel 1012*b* to an exhaust port B. This describes the fluid glow in the direction of the arrowheads.

The thermal circuit includes thermal conduction elements 1020 that thermally link the fluid in channel 1012*a* to the fluid in 1012*b*. This exchange not only preconditions the pressured non-ideal gas in channel 1210*a* but also relieves thermal stresses in a substrate caused by larger temperature difference between fluids in the two channels. Thermal conduction affecting the non-ideal gas under pressure, and the efficiency of the cryocooler, also occurs along the length of the supply channels 1012*a* indicated by conduction length 1013. While good conduction through conduction elements 1020 is desirable, thermal conduction along conduction length 1013 is undesirable. Such conduction along length 1013 is reduced by avoiding contact with a conducting element along the full length 1013, e.g., by breaks in the thermally conductive material along the channel 1012*a*. The cooling provided by the adiabatic expansion of non-ideal gas at nozzle 1018 into reservoir 1016 is harvested by thermal conducting elements between at least a portion of the reservoir 1016 and the object to be cooled 1084, such as a focal plane array (FPA) and integrated circuit (IC).

Figure 11:
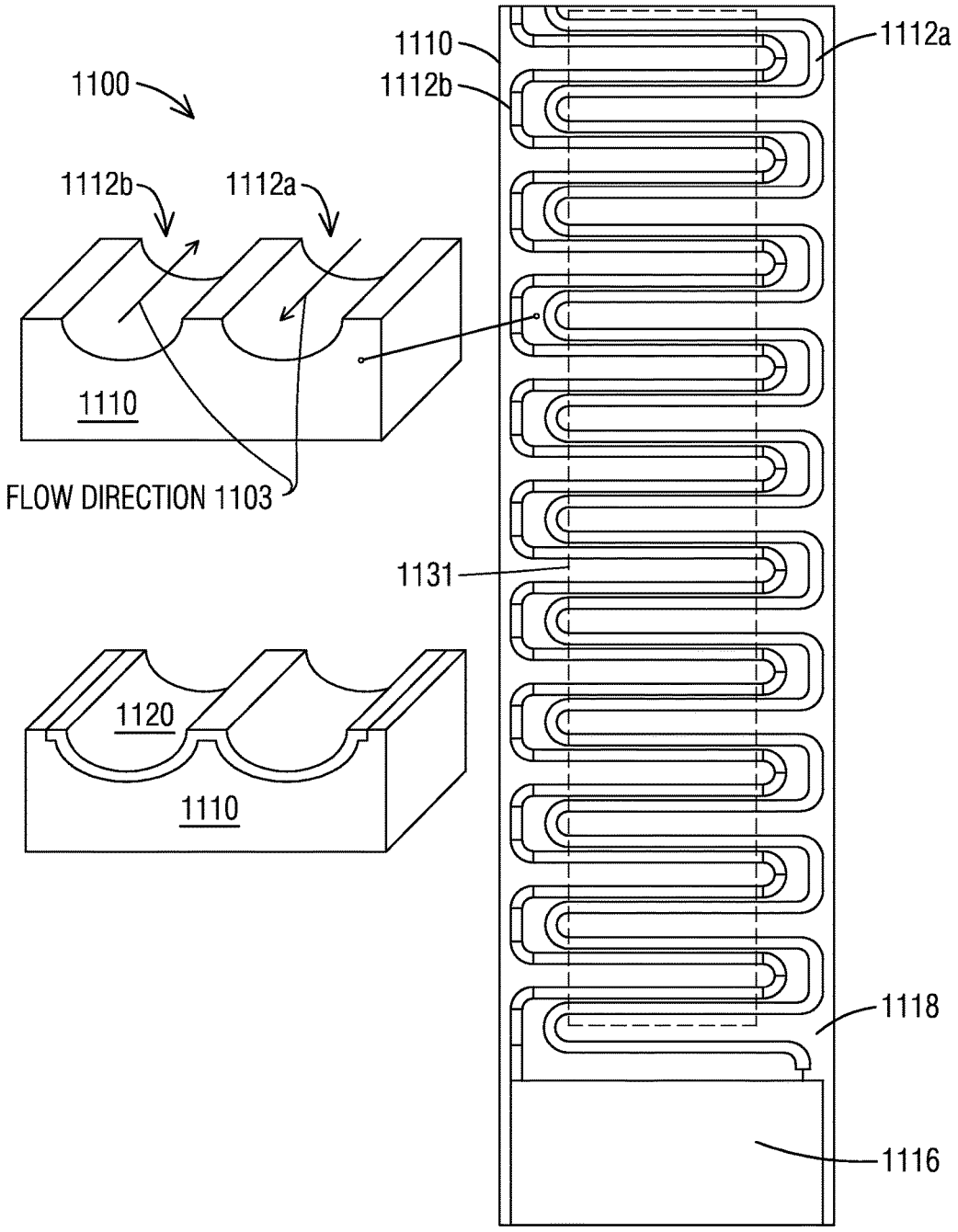
FIG. 11 is a block diagram that illustrates an example layout of microchannels for fluidic circuits and thermal conductors for thermal circuits on a substrate to implement counter-flow heat exchange (CFHX) in a Joule-Thompson cryocooler, according to an embodiment.

FIG. 11 is a block diagram that illustrates an example layout of microchannels for fluidic circuits and thermal conductors for thermal circuits on a substrate 1110 to implement counter-flow heat exchange (CFHX) in a Joule-Thompson cryocooler 1100, according to an embodiment. The substrate 110 includes channel 1112*a* (corresponding to channel 1012*a*) to supply a non-ideal gas under pressure, nozzle 1118 (corresponding to nozzle 1018), reservoir 1116 (corresponding to reservoir 1016), and channel 1112*b* (corresponding to channel 1012*b*) to remove the exhaust low-pressure non-ideal gas.

Thermal conduction between channels is provided by depositing a thermally conductive thin layer 1120, called a thermal strap, in area 1131. In various embodiments the thermally conductive thin layer 1120 comprises polysilicon or a titanium/nickel alloy. Thermal conduction along channel 1112*a* is interrupted by not depositing the thermally conductive thin layer 1120 along repeated sections of channel 1112*a* outside the area 1131, such as at the turns. However, in some embodiments, thermal conduction along channel 1112*a* is acceptable; and, in some such embodiments, the area 1131 is expanded to cover all parts of the channels 1112*a* and 1112*b*.

An upper insert indicates a portion of substrate 1110 outside area 1131, with channels 1112*a* and 112*b* absent the thermally conductive thin layer. Fluid flow direction is indicated by arrows 1103. A lower insert indicates a portion of substrate 1110 inside area 1131 with channels 1112*a* and 112*b* coated by the thermally conductive thin layer 1120.

Thus, in some embodiments, a system is constructed with glass substrates in which the channels are coplanar with the substrate surface and run parallel to one another in the counter-flow heat exchange region of the device. A thermal strap 1120 comprised of a thin film of metal or other material of high thermal coefficient is used to replace a select portion of the wall separating portions of channels 1112*a* and 112*b*. For example, such a thermal strap 1120 that is a third of the depth and one half the width of the channels 1112*a* and 112*b* affords a heat transfer advantage as much as three orders of magnitude greater than the equivalent wall made of the substrate glass alone. Using thin film deposition processing also offers an extremely precision machined, high purity counter-flow heat exchanger which can be easily integrated with any co-planar micro-cooler fabrication process. These advantages allow the designer greater flexibility in making thicker and/or stronger supportive walls separating the high and low pressure channels.

In some example embodiments, the spreading of normally sharp thermal gradients is accomplished by patterning a wide thermal strap throughout the reservoir or at other locations. Phase-transition Joule-Thomson cooling involves chaotic flows and condensation patterns, which in turn create extreme divergence in heat flow patterns which have the potential to impart high levels of mechanical stress in the substrate material. In such cases, a thermal spreader circuit by use of a thermal strap would not only alleviate the stress, but can be tapped by a temperature probe to measure device condition and operability.

While particular embodiments have been described, it will be understood by those skilled in the art that various changes, omissions and/or additions may be made and equivalents may be substituted for elements thereof without departing from the spirit and scope of the embodiments. In addition, many modifications may be made to adapt a particular situation or material to the teachings of the embodiments without departing from the scope thereof. Therefore, it is intended that the embodiments not be limited to the particular embodiment disclosed as the best mode contemplated, but that all embodiments falling within the scope of the appended claims are considered. Moreover, unless specifically stated, any use of the terms first, second, etc., does not denote any order or importance, but rather the terms first, second, etc., are used to distinguish one element from another.

We claim:

1. An apparatus comprising:

a first substrate of a first material having a first bonding surface along a plane;

a plurality of parallel fluidic channels being coplanar and disposed in the first substrate and open at the plane of the first bonding surface, each fluidic channel having side walls and a floor, wherein adjacent fluidic channels have a length of parallel channel portions at a first depth in the first substrate and being divided by a first substrate barrier, wherein a first fluidic channel of the adjacent fluidic channels has a first fluid flow direction and a second fluidic channel of the adjacent fluidic channels has a second fluid flow direction different from the first fluid flow direction;

a different second material comprising a thermally conductive counter-flow heat exchanger (CFHX) material; and an area formed in a first length portion of the length in the first substrate, the area including:

a first area channel (FAC) formed in the first fluidic channel within the first length portion to a second depth below the first depth, the FAC surrounds the side walls and the floor of the first fluidic channel, a second area channel (SAC) formed in the second fluidic channel within the first length portion to the second depth and being adjacent to the FAC, the SAC surrounds the side walls and the floor of the second fluidic channel, and an area barrier formed in the first substrate barrier in the first length portion to have a height below the first bonding surface between and to adjacent walls of the FAC and the SAC along the first length portion, wherein the CFHX material being deposited in the FAC up to the first depth, deposited in the SAC up to the first depth, and deposited on the area barrier; and an outer surface of the CFHX material disposed on the area barrier is at the plane of the first bonding surface; and a second substrate having a second bonding surface in contact with the first bonding surface, the second substrate configured to confine fluid flow within the plurality of fluidic channels.

2. The apparatus as recited in claim 1, further comprising:

a different third material; and a second area formed in a second length portion of the length in the first substrate for deposit of the third material, the second area including:

a third area channel (TAC) formed in the first fluidic channel within the second length portion to a third depth below the first depth, the TAC surrounds the side walls and the floor of the first fluidic channel, a fourth area channel (FOAC) formed in the second fluidic channel within the second length portion to the third depth and being adjacent to the TAC, the FOAC surrounds the side walls and the floor of the second fluidic channel, and a second area barrier formed in the first substrate barrier in the second length portion to a second height below the first bonding surface between and to adjacent walls of the TAC and the FOAC along the second length portion.

3. The apparatus as recited in claim 1, wherein at least one of the plurality of fluidic channels is a microchannels.

4. The apparatus as recited in claim 1, wherein at least one of the plurality of fluidic channels is a nanochannel.

5. The apparatus as recited in claim 1, wherein the second material has a different thermal conductivity from the first material.

6. The apparatus as recited in claim 1, wherein the second material has a different electrical conductivity from the first material.

7. The apparatus as recited in claim 1, wherein the second material has a different chemical permeability from the first material.

8. The apparatus as recited in claim 1, wherein the second substrate includes one or more access ports in fluid connection with the plurality of fluidic channels.

9. The apparatus as recited in claim 1, wherein the second material is a metal.

10. The apparatus as recited in claim 5, wherein the first material is a first thermally insulating material and the second substrate is made of a second thermally insulating material.

11. The apparatus as recited in claim 1, wherein the apparatus is a Joule-Thompson cryocooler apparatus; and the first fluidic channel being a single winding channel that folds back on itself to form a series of first parallel channel portions and the second fluidic channel being a single winding channel that folds back on itself to form a series of second parallel channel portions wherein the first parallel channel portions are adjacent to, parallel to, and alternate with the second parallel channel portions.

12. The apparatus as recited in claim 10, wherein the first thermally insulating material is transparent.

13. The apparatus as recited in claim 10, wherein the first thermally insulating material is glass.

14. The apparatus as recited in claim 1, wherein the second substrate includes one or more access ports in fluid connection with the plurality of fluidic channels.

15. The apparatus as recited in claim 11, wherein the second material is selected from a group comprising polysilicon and titanium/nickel alloy.

16. The apparatus as recited in claim 1, further comprising a second plurality of parallel fluidic channels disposed in the second substrate and open at the second bonding surface, each fluidic channel in the second substrate having side walls and a floor at a third depth in the second substrate wherein adjacent fluidic channels of the second plurality of fluidic channels having a third fluidic channel and a fourth fluidic channel with a second length of parallel channel portions and being divided by a second substrate barrier of the second substrate; and a second area formed in the second substrate and being aligned with the area in the first substrate for deposit of the thermally conductive counter-flow heat exchanger (CFHX) material, the second area in the second substrate including:

a third area channel (TAC) formed in the third fluidic channel in the second substrate to a fourth depth above the third depth, the TAC surrounds the side walls and the floor of the third fluidic channel of the second substrate, a fourth area channel (FOAC) formed in the fourth fluidic channel in the second substrate to the fourth depth, the FOAC surrounds the side walls and the floor of the fourth fluidic channel of the second substrate, and a second area barrier formed in the second substrate barrier to have a height above the second bonding surface between and to adjacent walls of the TAC and the FOAC.

17. The apparatus as recited in claim 16, wherein the second plurality of fluidic channels in the second substrate is a mirror image of the plurality of fluidic channels in the first substrate.

18. The apparatus as recited in claim 11, further comprising a layer of malleable sealing material disposed on at least one of the first substrate at the first bonding surface and the second substrate at the second bonding surface.

19. The apparatus as recited in claim 18, wherein the sealing material has lower thermal conductivity than the thermally conductive material.

20. The apparatus as recited in claim 18, wherein the sealing material is gold.

* * * * *